US010992076B2

(12) United States Patent
Tanaka

(10) Patent No.: US 10,992,076 B2
(45) Date of Patent: Apr. 27, 2021

(54) CONNECTOR IN WHICH BOSS CAP PASSING THROUGH WATER-PROOF SEAL CONTACTS WITH TERMINAL HOLDING BODY, AND CONNECTOR ASSEMBLY METHOD INCLUDING THE SAME

(71) Applicant: HIROSE ELECTRIC CO., LTD., Tokyo (JP)

(72) Inventor: Hironori Tanaka, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/811,748

(22) Filed: Mar. 6, 2020

(65) Prior Publication Data

US 2020/0295502 A1 Sep. 17, 2020

(30) Foreign Application Priority Data

Mar. 14, 2019 (JP) ..... JP2019-046717

(51) Int. Cl.
*H01R 13/52* (2006.01)
*H01R 13/506* (2006.01)

(52) U.S. Cl.
CPC ..... *H01R 13/5208* (2013.01); *H01R 13/506* (2013.01); *H01R 13/5213* (2013.01)

(58) Field of Classification Search
CPC ..... H01R 13/5208; H01R 13/506; H01R 13/5213
See application file for complete search history.

(56) References Cited

U.S. PATENT DOCUMENTS 4,776,813 A * 10/1988 Wilson ..... H01R 13/5208 439/587
6,283,793 B1 * 9/2001 Nakata ..... H01R 13/5808 439/607.48
2020/0295502 A1 * 9/2020 Tanaka ..... H01R 43/005

FOREIGN PATENT DOCUMENTS

JP H11-329567 11/1999
JP 2014-212064 A 11/2014
JP 2014212064 A * 11/2014

OTHER PUBLICATIONS

European Search Report dated Jun. 12, 2020, 9 pages.

* cited by examiner

*Primary Examiner* — Abdullah A Riyami
*Assistant Examiner* — Nader J Alhawamdeh
(74) *Attorney, Agent, or Firm* — Rankin, Hill & Clark LLP

(57) ABSTRACT

A connector includes a housing, a terminal holding body disposed inside the housing, a water-proof seal disposed inside the housing and coming into tightly contact with an inner circumferential face of the housing, and a cap fixed to the housing and pressing the water-proof seal. The water-proof seal has a seal side through hole receiving passing-through of the cable and a boss through hole formed in parallel to the seal side through hole. The cap has a cap side through hole receiving passing-through the cable at a position corresponding to the seal side through hole. The cap has a boss which is protruded from an opposite face facing to the water-proof seal toward the terminal holding body, passes through the boss through hole and comes into contact with the terminal holding body.

10 Claims, 14 Drawing Sheets

CONNECTOR IN WHICH BOSS CAP PASSING THROUGH WATER-PROOF SEAL CONTACTS WITH TERMINAL HOLDING BODY, AND CONNECTOR ASSEMBLY METHOD INCLUDING THE SAME

INCORPORATION BY REFERENCE

This application is based on and claims the benefit of priority from Japanese Patent application No. 2019-046717 filed on Mar. 14, 2019, which is incorporated by reference in its entirety.

TECHNICAL FIELD

The present invention relates to a connector having water-proof function and an assembly method for the connector.

BACKGROUND

For example, Patent literature 1 (Japanese Patent Publication H11-329567) discloses a water-proof connector in which an electric wire is passed through a wire insertion hole of a rubber plug and a terminal attached to the end portion of the electric wire is inserted into a housing, and the outer circumference of the rubber plug is tightly brought into contact with the inner wall face of the rear end portion of the housing. A small diameter compressed region is formed at an inner side of the housing, and a large diameter temporally holding region is formed at an opening side of the housing. A cover body is fitted onto the outside of the rear end portion of the housing, and on an inner face of the cover body, a pressing part facing to the rear end face of the rubber plug is protruded. In a state that the rubber plug is in the temporally holding region, when the cover body is pressed to be fitted onto the outside of the housing, the rubber plug is pressed by the pressing part to be displaced from the temporally holding region to the compressed region.

SUMMARY OF THE INVENTION

For example, when extraction force acts on the electric wire (a cable), in a case of the above-mentioned connector, most of the extraction force is transmitted to the rubber plug via the housing and the terminal. Then, because the rubber plug is remarkably deformed, a gap is formed between the inner wall face of the housing and the rubber plug. As a result, in some cases, it is impossible to keep water-proof condition.

The present invention is made in view of the above-mentioned problem to provide a connector capable of restraining excessive deformation of a water-proof seal and keeping water-proof condition and an assembly method for the connector.

To solve the above-mentioned problem, a first aspect of a connector of the present invention includes a housing formed into a cylindrical shape; a terminal holding body holding a terminal fixed to a tip end portion of a cable in an axial direction, and disposed inside the housing; a water-proof seal disposed inside the housing so as to face to a base end portion of the terminal holding body in the axial direction, and coming into tightly contact with an inner circumferential face of the housing; and a cap fixed to the housing so as to face to a base end portion of the water-proof seal in the axial direction, and pressing the water-proof seal. The water-proof seal has a seal side through hole through which the cable is passed, and a boss through hole formed in parallel to the seal side through hole. The cap has a cap side through hole through which the cable is passed at a position corresponding to the seal side through hole. One of the terminal holding body and the cap has a boss which is protruded from an opposite face facing the water-proof seal toward the other of the terminal holding body and the cap, passes through the boss through hole and comes into contact with the other of the terminal holding body and the cap.

The first aspect of the connector has a configuration such that the boss extending from the cap (the terminal holding body) passes through the water-proof seal and comes into contact with the terminal holding body (the cap). According to the configuration, for example, it is possible to transmit force for extracting the cable from the terminal holding body to the boss and then to the cap via the boss. Thereby, since force transmitted to the water-proof seal is deceased (or lost), it is possible to restrain excessive deformation of the water-proof seal. As a result, it is possible to continuously keep the water-proof condition by the water-proof seal suitably. The force transmitted to the cap via the boss is transmitted to the housing to which the cap is fixed.

In a second aspect of the connector of the present invention, in the above described first aspect of the connector, the terminal holding body may have a terminal fitting groove into which the terminal is fitted, and the terminal fitting groove may be recessed from an outside to an inside in a radial direction of the terminal holding body perpendicular to the axial direction of the cable.

According to the second aspect of the connector, it is possible to fit the terminal into the terminal fitting groove from the outside in a radial direction of the terminal holding body. Therefore, for example, compared with a case where the terminal is inserted into a hole extending in the axial direction, it is possible to make the terminal holding body hold the terminal easily.

In a third aspect of the connector of the present invention, in the above described second aspect of the connector, the terminal may be one of a plurality of the terminals corresponding to a plurality of the cables, and the terminal holding body may have a plurality of the terminal fitting grooves corresponding to the plurality of the terminals.

As a conventional configuration other than the present invention, a case where the terminal holding body has a plurality of holes for inserting the plurality of terminals will be considered. In this case, because it is very difficult to insert the plurality of terminals into the plurality of holes at the same time, the operator conventionally inserts the terminals one by one into the hole. In a state that one terminal fixed to one cable is inserted into one hole, when the other terminal fixed to the other cable is inserted into the other hole, it is necessary to bend the cable while loosening in order to direct the other terminal to the opening of the other hole. Then, it is required for all the cables to have a longer length considering the loosening. Then, the terminal holding body and the others becomes long in the axial direction in order to correspond to the cables longer than necessary, and the connector is inhibited from downsizing. By contrast, for such a problem, according to the third aspect of the connector, it is possible to fit the terminals into the terminal fitting grooves from the outside in the radial direction of the terminal holding body without loosening the cables. Thereby, it is possible for the cables to have a required minimum length and to downsize the connector.

In a fourth aspect of the connector of the present invention, in any of the above described first to third aspects of the connector, the other of the terminal holding body and the cap may have a boss fitting recess, and the boss may have a boss main body protruded from the one of the terminal holding body and the cap, and a fitting tip end part having a cross section smaller than a cross section of the boss main body and connected to a tip end portion of the boss main body via a contact face, and the contact face of the boss main body may come into contact with an outer edge portion of the boss fitting recess, and the fitting tip end part may be fitted into the boss fitting recess.

According to the fourth aspect of the connector, by fitting the fitting tip end part of the boss into the boss fitting recess, it is possible to position the cap to the terminal holding body easily.

In a fifth aspect of the connector of the present invention, in any of the above described first to fourth aspects of the connector, the water-proof seal may have a posture setting hole opened in only one of a tip end portion and the base end portion of the water-proof seal in the axial direction, and one of the terminal holding body and the cap may have a posture setting boss which is protruded from the opposite face facing to the water-proof seal toward the other of the terminal holding body and the cap and is inserted into the posture setting hole.

According to the fifth aspect of the connector, when the operator directs the posture setting hole on a side of the posture setting boss, an orientation of the water-proof seal can be uniquely determined. Thereby, it is possible to prevent mistaking of the orientation of the water-proof seal at the assembly of the connector.

In a sixth aspect of the connector of the present invention, in any of the above described first to fifth aspects of the connector, on an inner circumferential face of the cap side through hole, a plurality of contact projections may be projected toward a center in a radial direction of the cap side through hole at positions separated at intervals in a circumferential direction of the cap side through hole, and tip end portions of the plurality of contact projections may come into contact with an outer circumferential face of the cable disposed in the cap side through hole.

According to the sixth aspect of connector, the tip end portions of the plurality of contact projections come into approximately point contact with the outer circumferential faces of the cables. Therefore, compared with a case where the entire inner circumferential faces of the cap side through holes come into contact with the outer circumferential faces of the cables, it is possible to pass the cable through the cap side through hole easily. Furthermore, since the plurality of contact projections come into point contact with the outer circumferential faces of the cables, it is possible to restrain the binding (the twisting) of the cable extending to the outside from the cap side through holes. Accordingly, it is possible to restrain a gap between the cable and the seal side through hole from being formed owing the twisting of the cable.

In a seventh aspect of the connector of the present invention, in any of the above described first to sixth aspects of the connector, an inner press projection may be projected from an inner circumferential face of the housing, the inner press projection may be pressed on an outer face of the terminal holding body in a state that the terminal holding body is disposed inside the housing, an outer press projection may be projected from the outer face of the terminal holding body, and the outer press projection may be pressed on the inner circumferential face of the housing in the state that the terminal holding body is disposed inside the housing.

According to the seventh aspect of the connector, in a state that the terminal holding body is disposed inside the housing, the plurality of inner press projections are pressed on the outer face of the terminal holding body and the plurality of outer press projections are pressed on the inner circumferential face of the housing. Therefore, it is possible to restrain the looseness of the terminal holding body inside the housing.

In a eighth aspect of the connector of the present invention, in any of the above-described first to seventh aspects of the connector, a plurality of lock parts may be formed on an outer circumferential face of the housing at a base end side in the axial direction, the cap may have a plurality of locked parts to which the plurality of lock parts are locked in a state that the cap covers a base end portion of the housing in the axial direction, the cap may have a lock confirmation window which is opened at the base end side from the locked parts in the axial direction, and the base end side of the housing in the axial direction may be exposed via the lock confirmation window in a state that the lock parts are locked to the locked parts.

According to the eighth aspect of the connector, by locking the lock part with the locked part, the cap is locked to the housing. In such a lock state, the rear end portion of the housing is exposed via the lock confirmation window. According to the configuration, when the operator confirms the housing exposed via the lock confirmation windows, he can confirm that the cap is suitably locked to the housing. Thereby, it is possible to previously avoid mistaking the lock state in a state that the cap is not locked to the housing.

To achieve the object, a first aspect of an assembly method for a connector is an assembly method for a connector including a housing accommodating a terminal holding body holding a terminal fixed to a tip end portion of a cable in an axial direction, a water-proof seal coming into tightly contact with an inner circumferential face of the housing, and a cap pressing the water-proof seal. The assemble method includes: a first process for passing the cable through a seal side through hole formed in the water-proof seal and a cap side through hole formed in the cap; a second process for fixing the terminal to the tip end portion in an axial direction of the cable extending from the water-proof seal, and making the terminal holding body hold the terminal; a third process for inserting the terminal holding body holding the terminal inside the housing; and a fourth process containing the following steps. The fourth process contains a step for displacing the cap from a base end toward a axial tip end in the axial direction together with the water-proof seal and to dispose the water-proof seal inside the housing so as to face to a base end portion of the terminal holding body in the axial direction, a step for bringing a boss, protruding from one of the terminal holding body and the cap toward the other of the terminal holding body and the cap and passing through a boss through hole formed in the water-proof seal, into contact with the other of the terminal holding body and the cap, and a step for fixing the cap to the housing such that the cap faces to a base end portion of the water-proof seal in the axial direction.

In the first aspect of the assembly method for the connector, the water-proof seal is pushed by the cap to be displaced to the inside of the housing. Thereby, it is possible to push the water-proof seal by the cap with a constant and stable posture. Therefore, the water-proof seal is disposed inside the housing with a stable posture and comes into tightly contact with the inner circumferential face of the housing, and accordingly, it is possible to achieve suitable water-proof performance. Furthermore, since the boss extending from the cap (the terminal holding body) passes through the water-proof seal and comes into contact with the terminal holding body (the cap), for example, it is possible to transmit force for extracting the cable to the cap. Thereby, it is possible to restrain excessive deformation of the water-proof seal and to continuously keep the water-proof condition by the water-proof seal suitably.

In a second aspect of the assembly method for a connector, in the above-described first aspect of the connector, in the second process of the above-described first aspect of the assembly method for the connector, the terminal may be held to the terminal holding body by fitting the terminal into a terminal fitting groove recessed from an outside to an inside in a radial direction of the terminal holding body perpendicular to the axial direction.

According to the second aspect of the assembly method for the connector, since it is possible to fit the terminal into the terminal fitting groove from the outside in a radial direction of the terminal holding body, compared with a case where the terminal is inserted into a hole extending in the axial direction, it is possible to make the terminal holding body hold the terminal easily.

According to the present invention, it is possible to restrain excessive deformation of the water-proof seal and to keep the water-proof condition.

DETAILED DESCRIPTION

Hereinafter, with reference to the attached drawings, embodiments of the present invention will be described. In the following description, "X1", "X2", "Y1", "Y2", "Z1" and "Z2" represented in each figure respectively indicate "left", "right", "front", "rear", "upper" and "lower". Front and rear directions are an example of "an axial direction". Although terms indicating directions and positions are used in the specification, their terms are used for convenience for explanation, but not used to limit the technical scope of the present invention.

(Outline of Connector)

Figure 1:
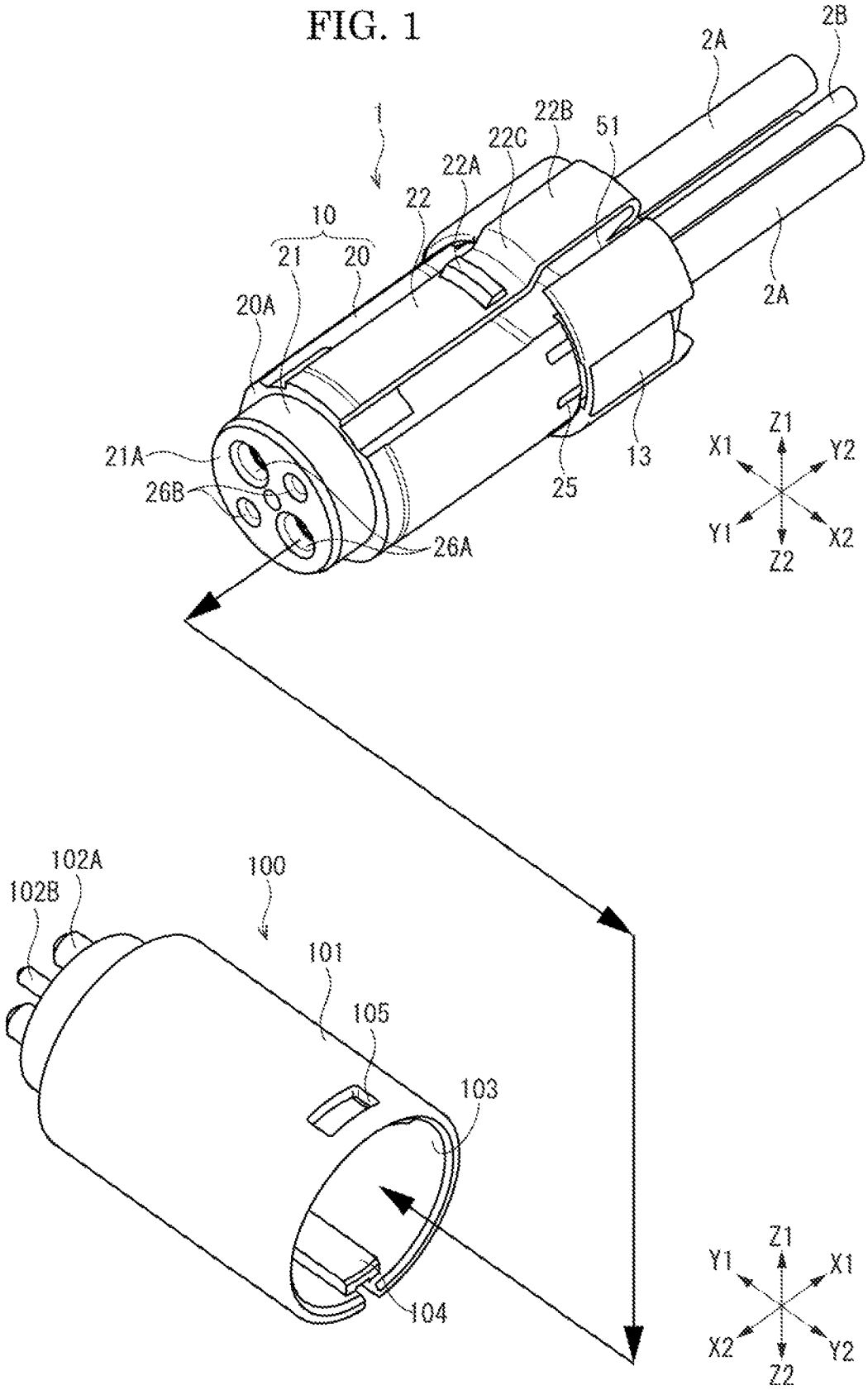
FIG. 1 is a perspective view showing a connector and a counter terminal according to one embodiment of the present invention.

With reference to FIG. 1, an outline of a connector 1 will be described. FIG. 1 is a perspective view showing the connector 1 and a counter connector 100.

The connector 1 is formed into an approximately cylindrical exterior shape. The connector 1 is electrically connected to a device (not shown) via four cables 2A and 2B, for example. The connector 1 is provided with four terminals 3A and 3B (refer to FIG. 2) disposed at approximately equal intervals in a circumferential direction of the connector 1 so as to correspond to the four cables 2A and 2B. The two cables 2A (the two terminals 3A) are disposed to face to each other across an axial center of the connector 1, and the remaining two cables 2B (the two terminals 3B) are disposed symmetrically with respect to the two terminals 3A in left and right directions (or upper and lower directions). The two cables 2A (the two terminals 3A) and the remaining two cables 2B (the two terminals 3B) are alternately disposed in the circumferential direction. Each of the cables 2A and 2B is a cord-like body having an approximately circular cross section, and is formed by covering a core wire (not shown) made of electric conductive material with an outer covering (not shown) made of electric insulation material. Each of the terminals 3A and 3B is formed into an approximately cylindrical shape. The two cables 2A are formed to be thicker in diameter than the remaining two cables 2B. In the same manner, the two terminals 3A are formed to be thicker in diameter than the remaining two terminals 3B.

(Outline of Counter Connector)

The connector 1 is formed to be capable of fitting into the counter connector 100 mounted on a circuit board (not shown). The counter connector 100 includes a counter housing 101 and four counter terminals 102A and 102B.

The counter housing 101 is formed into an approximately cylindrical shape, and is made of electric insulation material, such as synthetic resin, for example. The counter housing 101 has a counter side fitting recess 103 opened in a rear face of the counter housing 101 (an opposite face facing to the connector 1). Into the counter side fitting recess 103, the connector 1 is inserted. On a lower portion of an inner circumferential face of the counter housing 101 (the counter side fitting recess 103), a connection key 104 is protruded over almost the entire area along the front and rear directions. In an upper portion of the counter housing 101, a lock hole 105 is opened. On an inner side (a front end face) of the counter side fitting recess 103, an approximately annular counter side water-proof seal (not shown) is fixed.

Each of the counter terminals 102A and 102B is formed into an approximately columnar shape capable of being inserted in each of the terminals 3A and 3B, and is made of electric conductive material. Each of the counter terminals 102A and 102B is fixed in a state that penetrating a front end portion of the counter housing 101 in the front and rear directions. The four counter terminals 102A and 102B are disposed so as to correspond to the four terminals 3A and 3B of the connector 1. The two counter terminals 102A are formed to be thicker in diameter than the remaining two counter terminal 102B. In each of the counter terminal 102A and 102B, a portion extending outside the counter housing 101 is fixed to the circuit board, and a portion extending inside the counter housing 101 (the counter side fitting recess 103) is connected to each of the terminals 3A and 3B fitted into the counter side fitting recess 103.

(Configuration of Connector)

Figure 2:
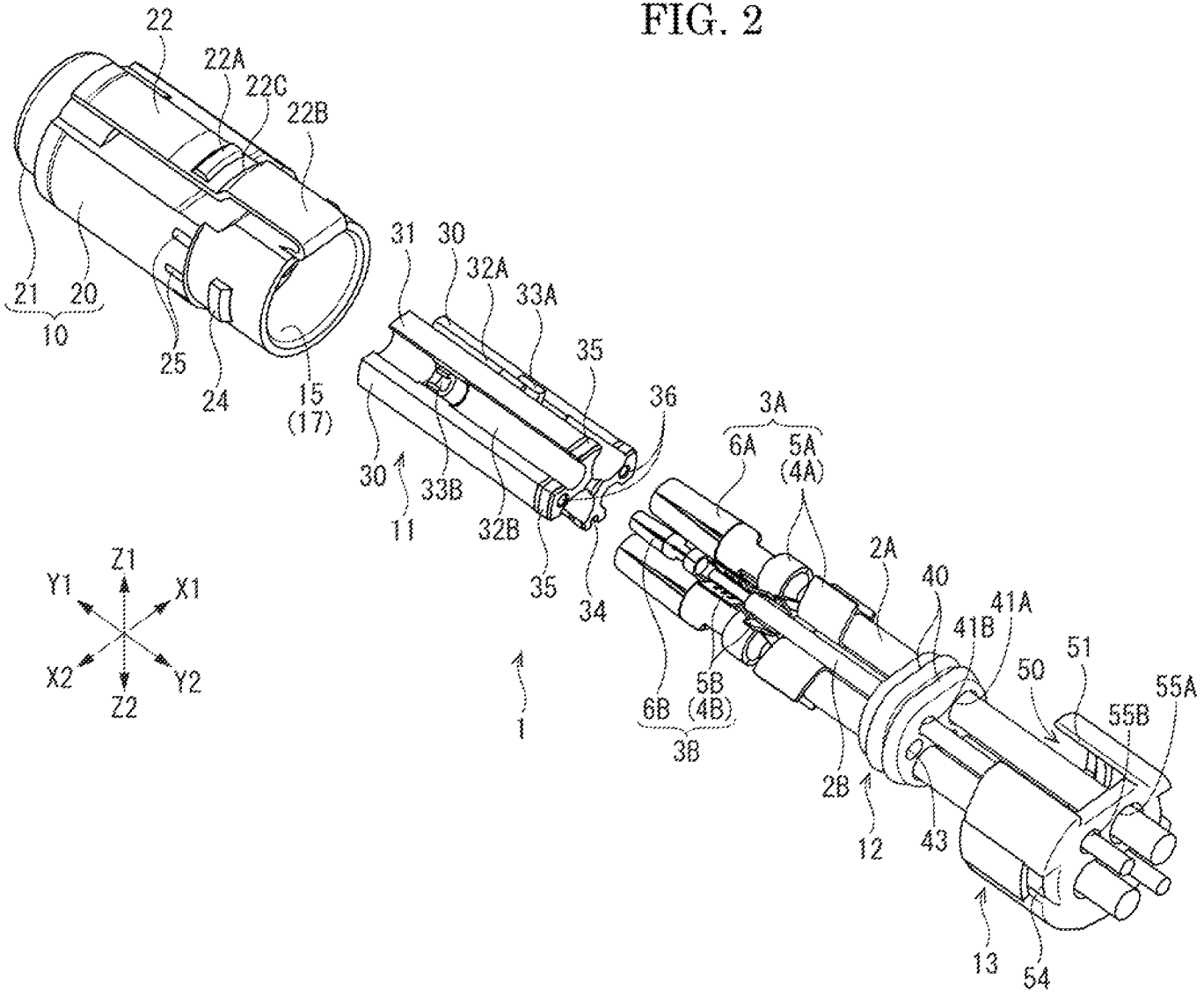
FIG. 2 is an exploded perspective view showing the connector according to the embodiment of the present invention.

Next, with reference to FIG. 2, a configuration of the connector 1 will be described in detail. FIG. 2 is an exploded perspective view showing the connector 1.

As shown in FIG. 2, the connecter 1 includes a housing 10, a terminal holding body 11, a water-proof seal and a cap 13. The housing 10 is formed into an approximately cylindrical shape extending in the front and rear directions. The terminal holding body 11 holds the terminals 3A and 3B fixed to tip end portions of the cable 2A and 2B in an axial direction. The water-proof seal 12 comes into tightly contact with the housing 10 and the cables 2A and 2B to water-tightly seal the inside of the housing 10. The cap 13 is fixed to the housing 10 so as to cover the water-proof seal 12 and presses the water-proof seal 12.

<Terminal>

Firstly, the terminals 3A and 3B will be described briefly. The two types terminals 3A and 3B different in thickness (size) have almost the same configuration, and the terminal 3A will be described as follows.

The terminal 3A includes a connection part 4A and a contact part 6A. The terminal 3A is manufactured by a press process of a metal plate, for example. The connection part 4A is a part to be coupled to the end portion of the cable 2A. The connection part 4A includes a plurality of barrels 5A for caulking the outer covering and the core wire of the cable 2A. The contact part 6A is connected to a front end portion (the tip end portion in an axial direction) of the connection part 4A. The contact part 6A is formed into an approximately cylindrical shape having a diameter being gradually decreased from the rear side to the front side. In the same manner as the terminal 3A, the terminal 3B includes a connection part 4B (a plurality of barrels 5B) and a contact part 6B.

<Housing>

Figure 3:
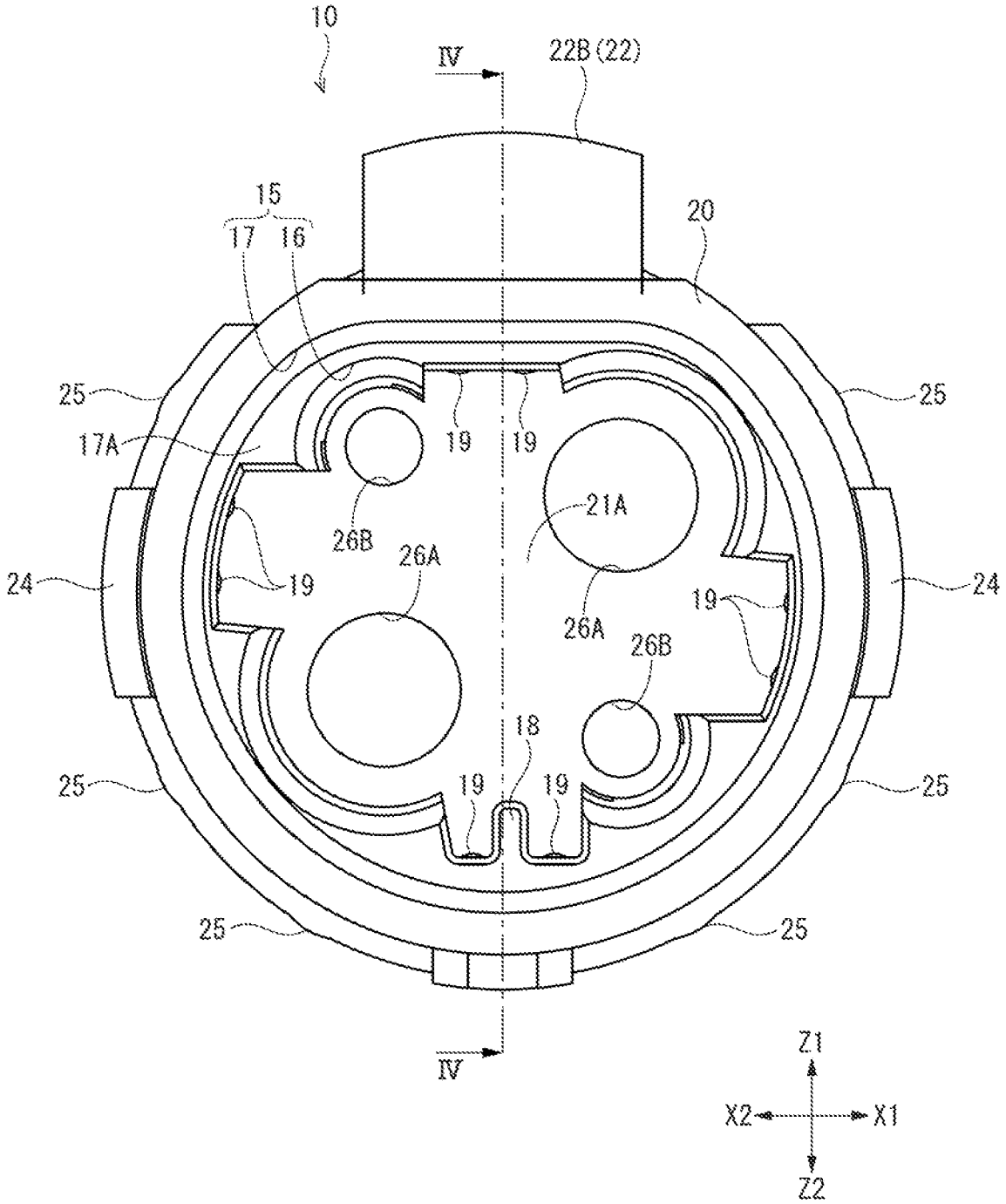
FIG. 3 is a back view showing a housing of the connector according to the embodiment of the present invention.
Figure 4:
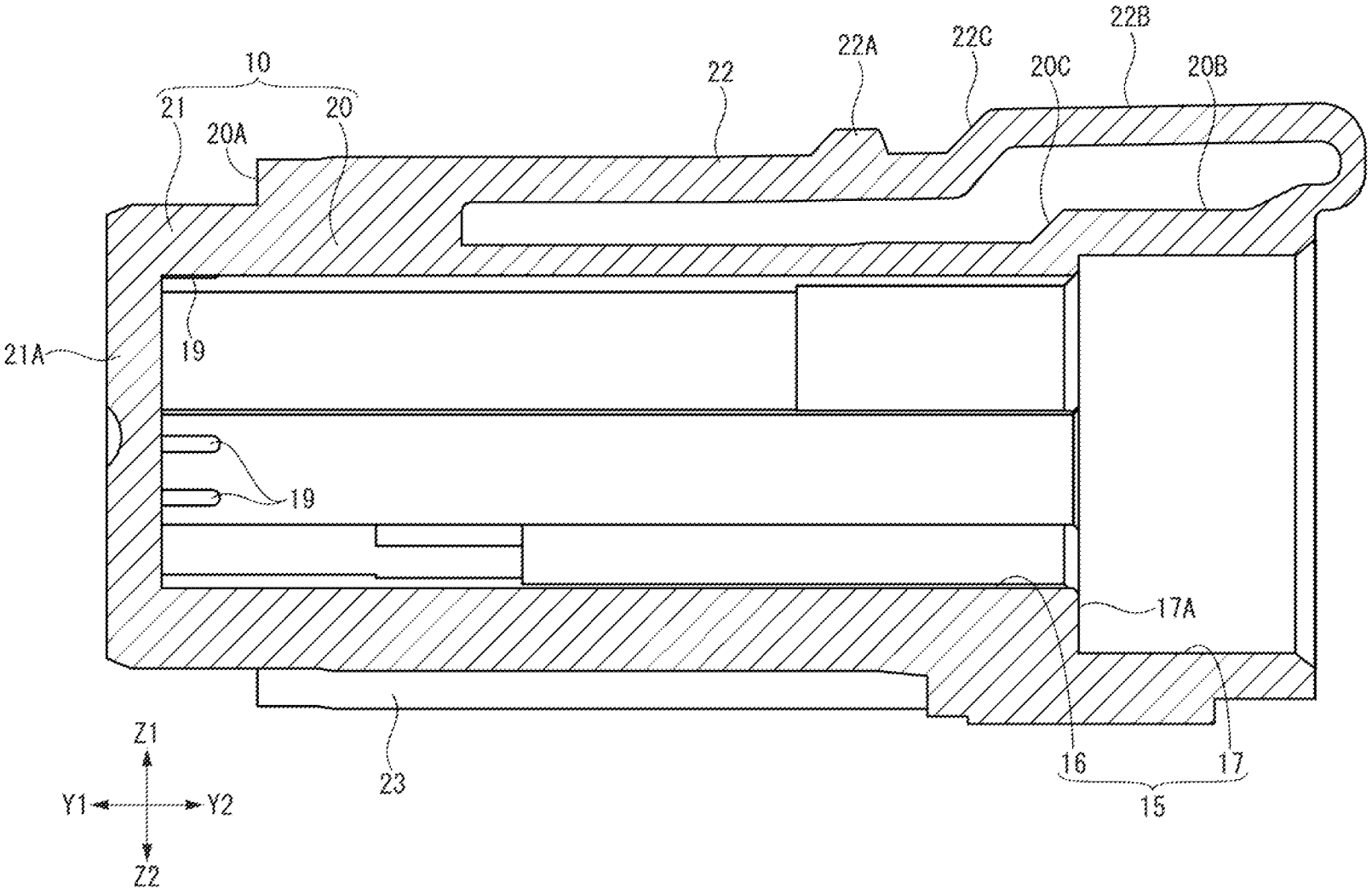
FIG. 4 is a sectional view showing a cross section of the housing taken along IV-IV line in FIG. 3.

Next, with reference to FIG. 1 to FIG. 4, the housing 10 will be described. FIG. 3 is a back view showing the housing 10. FIG. 4 is a sectional view showing a cross section of the housing 10 taken along the IV-IV line in FIG. 3.

As shown in FIG. 2, the housing 10 is formed into an approximately cylindrical shape, and is made of electric insulation material, such as synthetic resin, for example. The housing 10 has an exterior shape capable of being fitted into the counter side fitting recess 103 of the counter housing 101 (refer to FIG. 1). The housing 10 has a fitting recess 15 opened in a rear face of the housing 10.

The housing 10 includes a housing main body 20 and a tip end connection part 21. The housing main body 20 constitutes most of the housing 10 except a front portion of the housing main body 20. The tip end connection part 21 is formed into an approximately cylindrical shape having a diameter smaller than that of the housing main body 20, and is connected to a front end portion of the housing main body 20 via a connection contact face 20A. The housing main body 20 and the tip end connection part 21 are formed integrally, and the fitting recess 15 is formed over the housing main body 20 and the tip end connection part 21 (refer to FIG. 4).

<<Housing Main Body>>

As shown in FIG. 4, a rear upper face 20B of the housing main body 20 is formed to be higher by one step than the other upper face of the housing main body 20 via an inclined face 20C. As shown in FIG. 2 and FIG. 4, on the upper face of the housing main body 20, a lock operation part 22 is formed. The lock operation part 22 is bridged between the front end portion and a rear end portion of the housing main body 20 via a space from the upper face of the housing main body 20. The lock operation part 22 is formed into an approximately band-shape extending in almost parallel to the upper face of the housing main body 20. A lock rear portion 22B of the lock operation part 22 is formed to be higher by one step than the other portion of the lock operation part 22 via a lock inclined portion 22C so as to extend along the inclined face 20C and the rear upper face 20B of the housing main body 20. At a front side from the lock inclined portion 22C on the lock operation part 22, a lock protrusion 22A is protruded. A front end face of the lock protrusion 22A is inclined rearward from the upper face of the lock operation part 22 toward the outside in a radial direction of the housing main body 20.

On a lower portion of the housing main body 20, a connection key groove 23 (refer to FIG. 4) is recessed along almost the entire area in the front and rear directions. As shown in FIG. 2 and FIG. 3, on each of the left and right outer faces of a rear portion (at a base end side in the axial direction) of the housing main body 20, a pair of lock protrusions 24 (a lock part) are protruded. A rear end face of each lock protrusion 24 is inclined forward from an outer circumferential face of the housing main body 20 toward the outside in the radial direction of the housing main body 20. On the outer circumferential face of the housing main body 20, a plurality of connection press projections 25 are projected at intervals along a circumferential direction of the housing main body 20 at a front side from the lock protrusions 24. Each connection press projection 25 slightly rises from the outer circumferential face of the housing main body 20 toward the outside in the radial direction.

<<Tip Connection Part>>

As shown in FIG. 1 and FIG. 3, in a tip end wall 21A of the tip end connection part 21, four terminal holes 26A and 26B are opened for communicating the outside with the fitting recess 15. The four terminal holes 26A and 26B are formed to have shapes and positions corresponding to the four counter terminals 102A and 102B of the counter connector 100 (or the four terminals 3A and 3B of the connector 1). The four terminal holes 26A and 26B are formed in order to receive insertion of the four counter terminals 102A and 102B and to bring the counter terminals 102A and 102B into contact with the terminals 3A and 3B. A front edge portion of each of the terminal holes 26A and 26B is chamfered to be tapered.

<<Fitting Recess>>

As shown in FIG. 3 and FIG. 4, the fitting recess 15 is a space for accommodating the terminal holding body and the water-proof seal 12. The fitting recess 15 includes a holding body fitting part 16 and a seal fitting part 17.

<<Holding Body Fitting Part>>

The holding body fitting part 16 is a space between an inner face of the tip end wall 21A of the tip end connection part 21 and a front end of the rear upper face 20B of the housing main body 20. The holding body fitting part 16 has a complicated cross section in which a plurality of arcs is lined up in the circumferential direction of the housing main body 20 so as to have almost the same sectional shape as the terminal holding body 11 holding the terminals 3A and 3B (refer to FIG. 3). On a bottom face of the housing 10 forming the holding body fitting part 16, a fitting key 18 is protruded over almost the entire area in the front and rear directions (refer to FIG. 3). Additionally, on a top face, a bottom face and both left and right side faces of the tip end connection part 21 forming the holding body fitting part 16 (an inner circumferential face of the housing 10), a plurality of inner press projections 19 are projected. Each inner press projection 19 slightly rises from the inner circumferential face of the tip end connection part 21 toward the inside in the radial direction.

<<Seal Fitting Part>>

The seal fitting part 17 is a space between a rear end of the holding body fitting part 16 and a rear end of the housing main body 20. That is, the seal fitting part 17 is integrated with the holding body fitting part 16, and is an approximately columnar space in which a rear end face of the housing main body 20 is opened to the outside. The seal fitting part 17 has an approximately circular cross section having a diameter such that the entire of the holding body fitting part 16 is contained, when viewed from the rear side. Between (on a boundary between) the terminal holding body 11 and the seal fitting part 17, an annular seal contact face 17A is formed. A rear edge portion of the seal fitting part 17 is chamfered to be tapered.

<Terminal Fitting Body>

Figure 5:
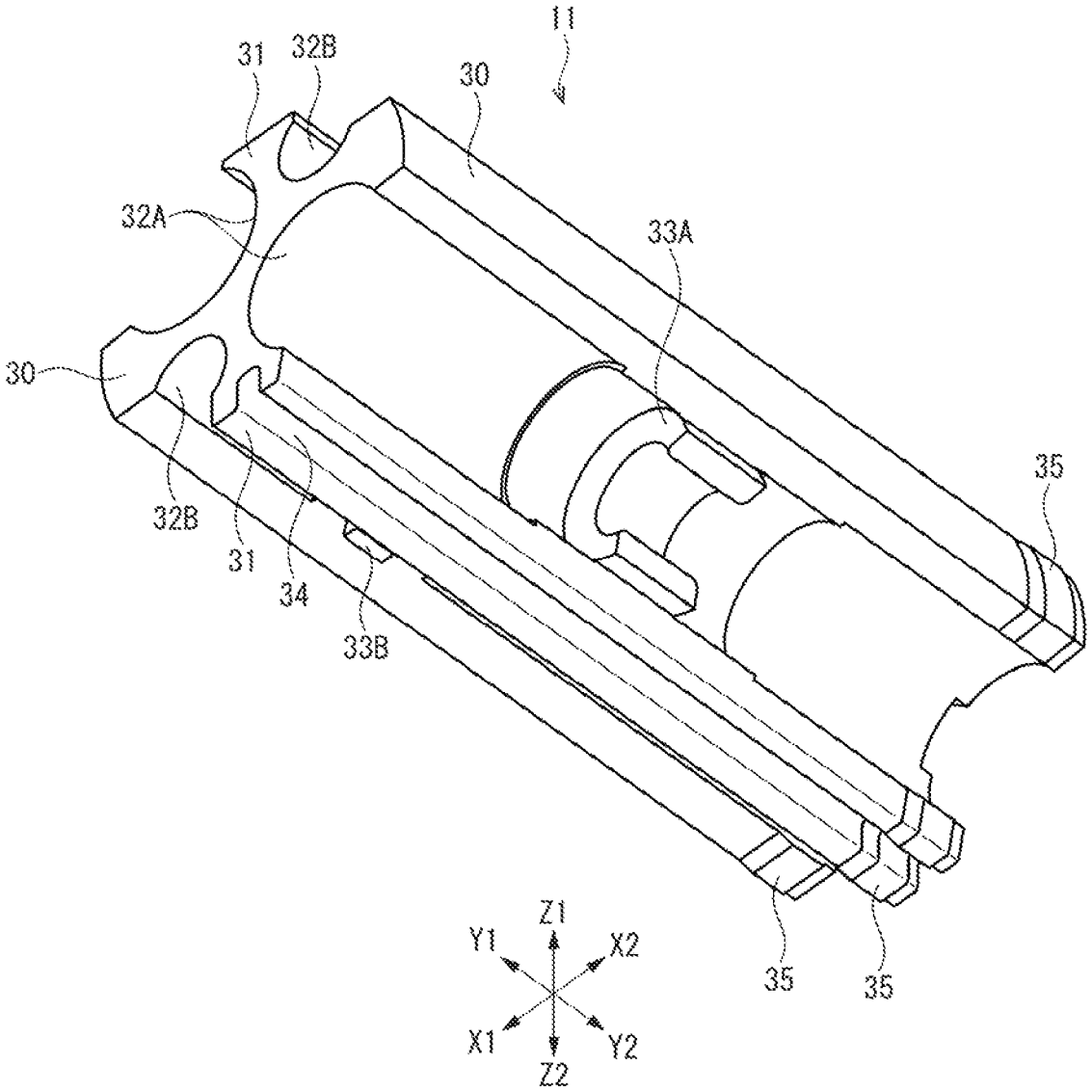
FIG. 5 is a perspective view showing a terminal holding body of the connector according to the embodiment of the present invention.

Next, with reference to FIG. 2 and FIG. 5, the terminal holding body 11 will be described. FIG. 5 is a perspective view showing the terminal holding body 11.

The terminal holding body 11 is formed to be capable of being fitted into the inside (the holding body fitting part 16) of the housing 10, and is made of electric insulation material, such as synthetic resin, for example. The terminal holding body 11 includes a pair of horizontal arm parts 30 and a pair of vertical arm parts 31. When the terminal holding body 11 is viewed from the front side (in the axial direction), the pair of horizontal arm parts 30 extend to both left and right sides from the axial center, and the vertical arm parts 31 extend to both upper and lower sides from the axial center. That is, the terminal holding body 11 is formed into an approximately rod-like shape having an approximately cross-shaped cross section.

The horizontal arm part 30 and the vertical arm part 31 are alternately disposed in a circumferential direction of the terminal holding body 11. Between the adjacently disposed vertical arm part 31 and horizontal arm part 30, a terminal fitting groove is formed into which one of the terminals 3A and 3B and one of the cables 2A and 2B are fitted, and four terminal fitting grooves 32A and 32B corresponding to the four terminals 3A and 3B and the four cables 2A and 2B are formed. Each of the terminal fitting grooves 32A and 32B is recessed from the outside to the inside in the radial direction (perpendicular to the axial direction). The two terminal fitting grooves 32A are disposed to face to each other across the axial center of the terminal holding body 11, and the remaining two terminal fitting grooves 32B are disposed symmetrically to the two terminal fitting grooves 32A in the left and right directions (or the upper and lower directions). Each of the terminal fitting grooves 32A and 32B is a groove having an approximately semi-circular cross section. Each terminal fitting groove 32A has a shape corresponding to the thicker terminal 3A or the like, and each terminal fitting groove 32B has a shape corresponding to the thinner terminal 3B or the like. On the middle portions of the terminal fitting grooves 32A and 32B in the front and rear directions, approximately C-shaped terminal clamping parts 33A and 33B are formed in order to hold the terminals 3A and 3B tightly.

On a lower end face of the vertical arm part 31 extending downward, a fitting key groove 34 is recessed over almost the entire area in the front and rear directions. On a rear outer face of the terminal holding body 11 (each vertical arm part 31 and each horizontal arm part 30), a plurality of outer press projections 35 is protruded. Each outer press projection 35 slightly rises from an outer face of each vertical arm part 31 or each horizontal arm part 30 toward the outside in the radial direction. On rear end faces of the pair of horizontal arm parts 30 (the terminal holding body 11), a pair of boss fitting recesses 36 are recessed (refer to FIG. 2). Each boss fitting recess 36 is a recess having an approximately circular cross section, and a rear edge portion of each boss fitting recess 36 is chamfered to be tapered.

<Water-Proof Seal>

Figure 6:
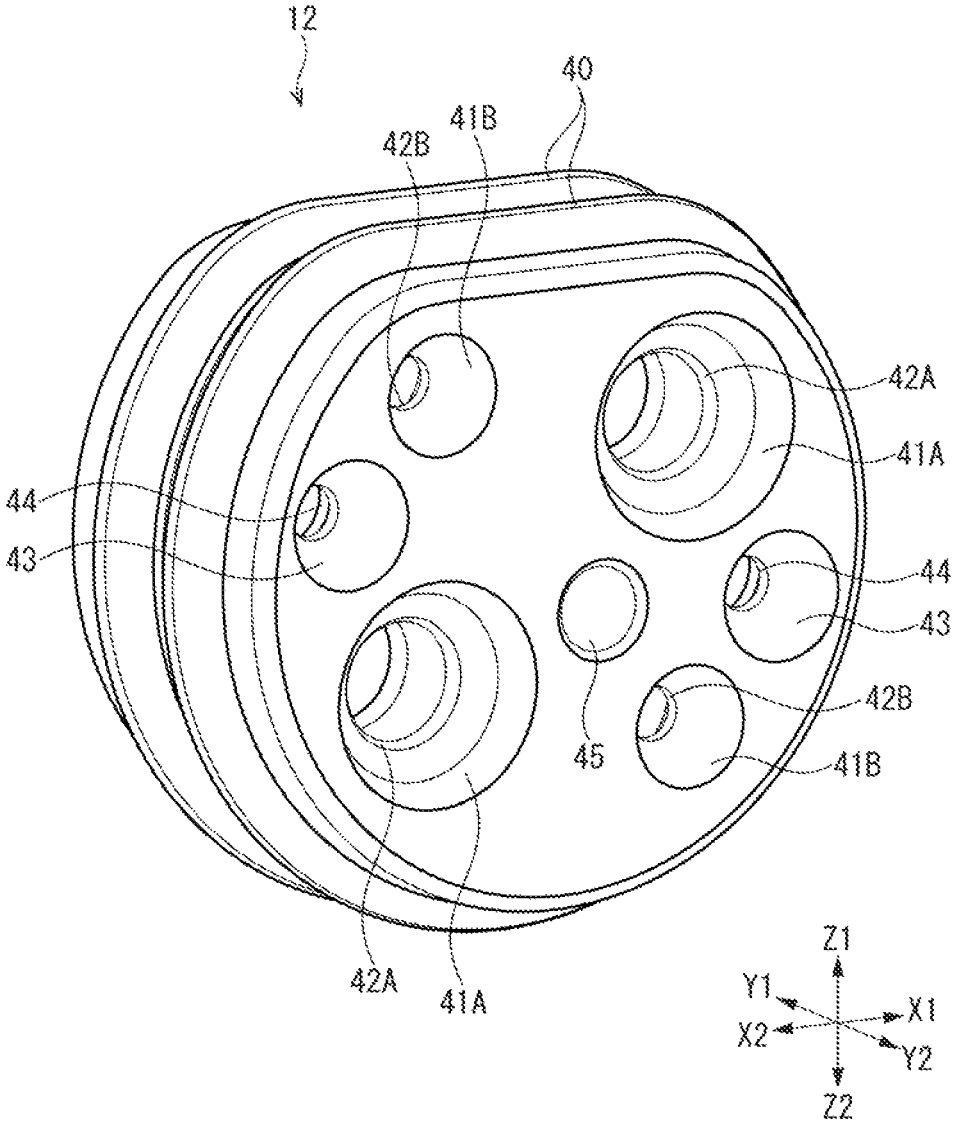
FIG. 6 is a perspective view showing a water-proof seal of the connector according to the embodiment of the present invention.

Next, with reference to FIG. 2 and FIG. 6, the water-proof seal 12 will be described. FIG. 6 is a perspective view showing the water-proof seal 12.

The water-proof seal 12 is formed into an approximately columnar shape, and is made of elastically deformable material, such as synthetic rubber, for example. The water-proof seal 12 is formed to be capable of being fitted into the inside (the seal fitting part 17) of the housing 10. On an outer circumferential face of the water-proof seal 12, two outer protruded parts 40 are formed over the entire circumference. The two outer protruded parts 40 are protruded from the outer circumferential face of the water-proof seal 12 toward the outside in a radial direction of the water-proof seal 12 at an interval in the front and rear directions.

In the water-proof seal 12, four seal side through holes 41A and 41B are formed through which the four cables 2A and 2B are passed. Each of the seal side through holes 41A and 41B is a hole penetrating the water-proof seal 12 in the front and rear directions. The four seal side through holes 41A and 41B are disposed at positions corresponding to the four terminal fitting grooves 32A and 32B of the terminal holding body 11 (the four cables 2A and 2B). That is, the two seal side through holes 41A are disposed to face to each other across the axial center of the water-proof seal 12, and the remaining two seal side through holes 41B are disposed symmetrically to the two seal side through holes 41A in the left and right directions (or in the upper and lower directions). The four seal side through holes 41A and 41B are formed to have diameters corresponding to the four cables 2A and 2B, respectively. On an inner circumferential face of each of the seal side through holes 41A and 41B, three inner protruded parts 42A and 42B are formed along the entire circumference. The three inner protruded parts 42A and 42B are protruded from the inner circumferential face of each of the seal side through holes 41A and 41B toward the inside in a radial direction of each of the seal side through holes 41A and 41B at intervals in the front and rear directions.

Furthermore, in the water-proof seal 12, two boss through holes 43 are formed in parallel to each of the seal side through holes 41A and 41B. The two boss through holes 43 are holes penetrating the water-proof seal 12 in the front and rear directions at both left and right sides of the water-proof seal 12 and between the seal side through holes 41A and 41B adjacently disposed in the upper and lower directions. The two boss through holes 43 are formed in order to receive passing-through of two bosses 57 of the cap 13 described later. Each boss through hole 43 has a diameter corresponding to the boss 57, and three boss protruded parts 44 are formed on an inner circumferential face of the boss through hole 43 over the entire circumference. The three boss protruded parts 44 are protruded from the inner circumferential face of each boss through hole 43 toward the inside in a radial direction of each boss through hole 43 at intervals in the front and rear directions.

Additionally, as shown in FIG. 6, near the center of the water-proof seal 12, a posture setting hole 45 is formed in parallel to each of the seal side through holes 41A and 41B. The posture setting hole 45 is opened only to a rear portion (a base end portion in the axial direction) of the water-proof seal 12.

Both front and rear edge portions of each of the seal side through holes 41A and 41B and each boss through holes 43 are chamfered to be tapered. The rear edge portion of the posture setting hole 45 is also chamfered to be tapered.

<Cap>

Figure 7:
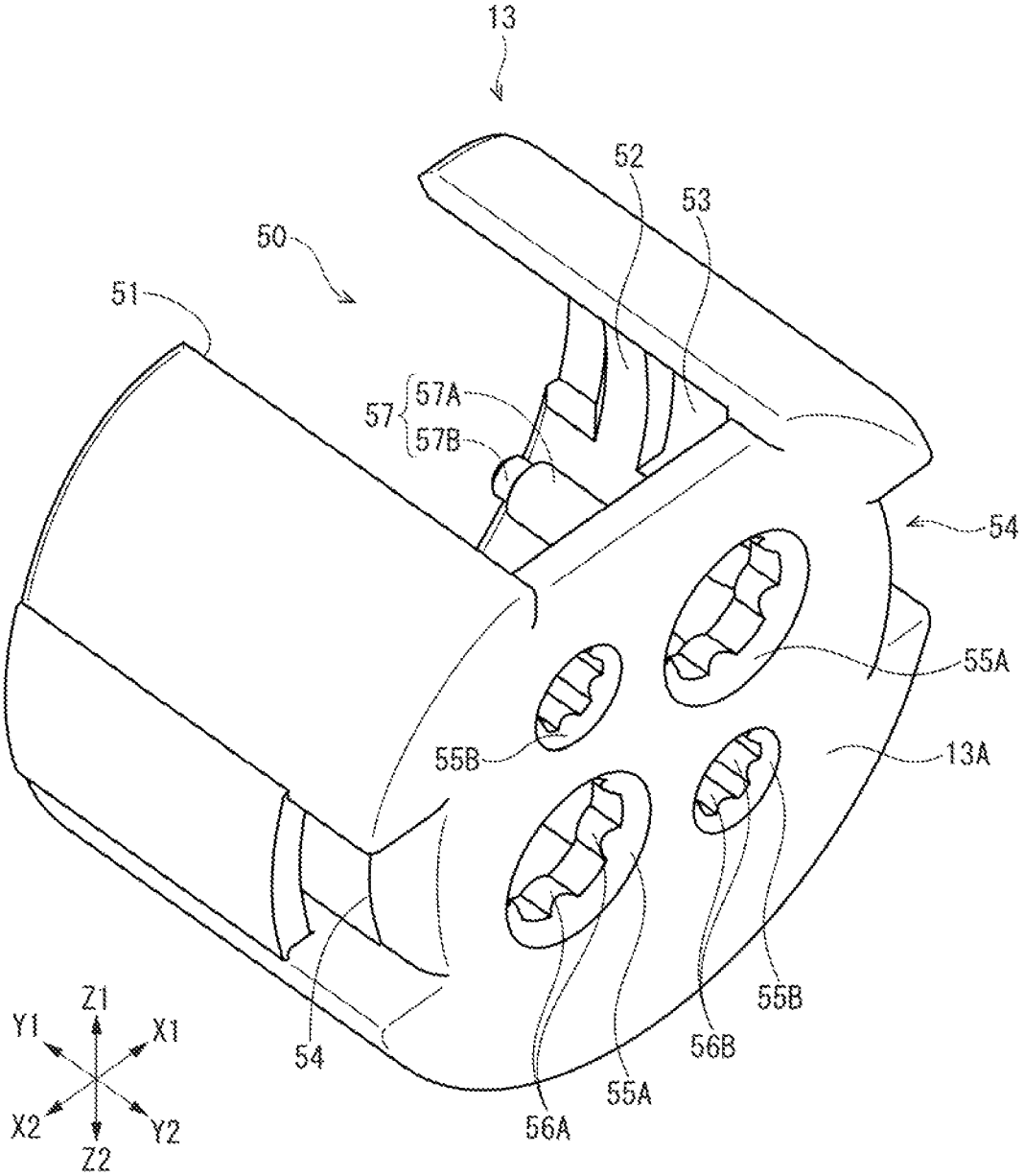
FIG. 7 is a perspective view showing a cap of the connector according to the embodiment of the present invention.
Figure 8:
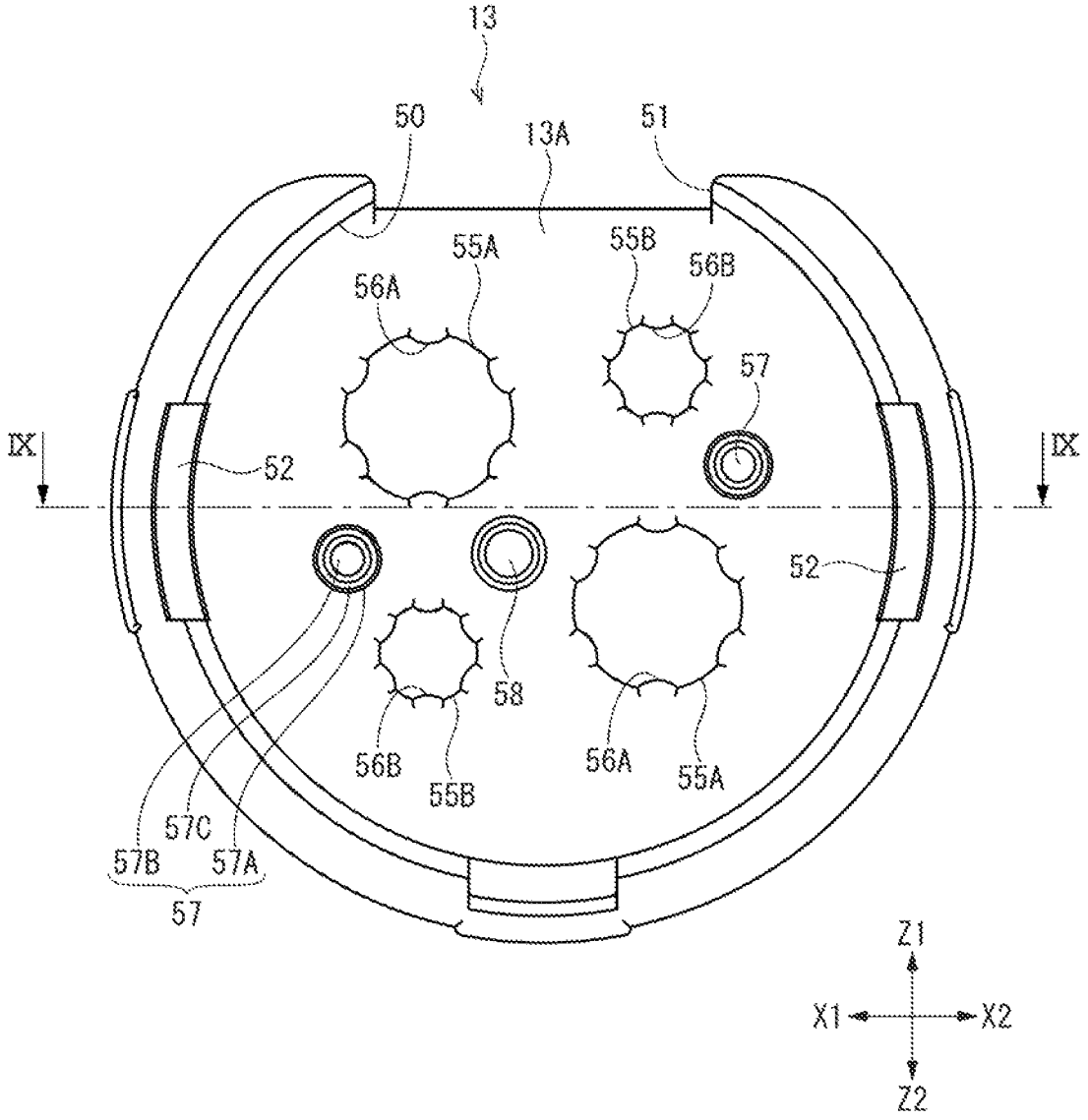
FIG. 8 is a front view showing the cap of the connector according to the embodiment of the present invention.
Figure 9:
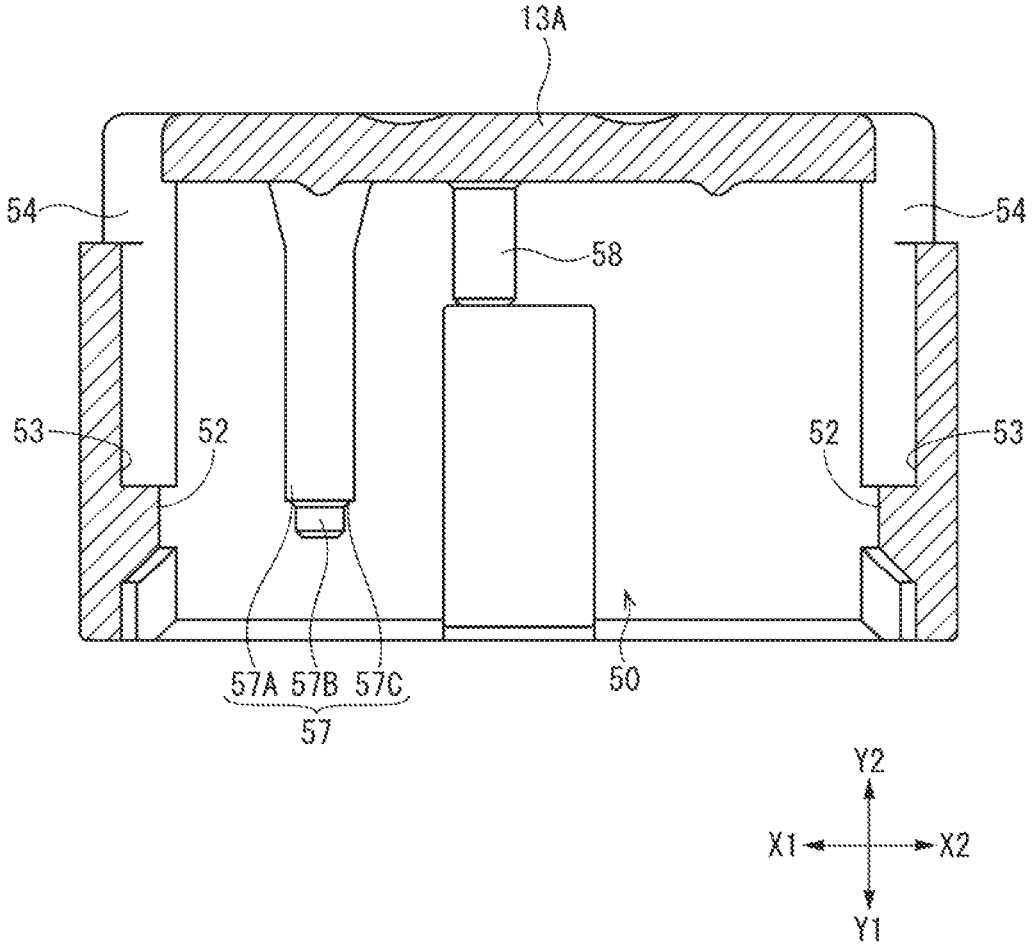
FIG. 9 is a sectional view showing a cross section of the cap taken along IX-IX line in FIG. 8.

Next, with reference to FIG. 2, FIG. 7 to FIG. 9, the cap 13 will be described. FIG. 7 is a perspective view showing the cap 13. FIG. 8 is a front view showing the cap 13. FIG. 9 is a sectional view showing the cross section of the cap 13 taken along the IX-IX line in FIG. 8.

As shown in FIG. 2 and FIG. 7, the cap 13 is formed into an approximately cylindrical shape, and is made of electric insulation material, such as synthetic resin, for example. In the cap 13, an attachment recess 50 opened in a front end face of the cap 13 is formed. Into the attachment recess 50, a rear end portion of the housing 10 is fitted. In an upper portion of the cap 13, an approximately rectangular cutout 51 is cut from a front end to near a rear end. In a state that the cap 13 is fitted onto the outside of the rear end portion of the housing 10, the lock operation part 22 (the lock rear portion 22B) is disposed in the cutout 51.

As shown in FIG. 7 and FIG. 8, in a base end wall 13A (a rear end face) of the cap 13, four cap side through holes 55A and 55B are formed in order to receive passing-through of the four cables 2A and 2B. Each of the cap side through holes 55A and 55B is a hole penetrating the base end wall 13A of the cap 13 in the front and rear directions, and communicates the outside with the attachment recess 50. The four cap side through holes 55A and 55B are disposed at positions corresponding to the seal side through holes 41A and 41B of the water-proof seal 12, respectively. That is, the two cap side through holes 55A are disposed to face to each other across to the axial center of the cap 13, and the remaining two cap side through holes 55B are disposed symmetrically to the two cap side through holes 55A in the left and right directions (or in the upper and lower direction). The four cap side through holes 55A and 55B are formed to have diameters corresponding to the four cables 2A and 2B, respectively. Both front and rear edge portions of each of the cap side through holes 55A and 55B are chamfered to be tapered.

Furthermore, on an inner circumferential face of each of the cap side through holes 55A and 55B, a plurality of contact projections 56A and 56B are respectively protruded toward the center in a radial direction of each of the cap side through holes 55A and 55B at intervals in a circumferential direction of each of the cap side through holes 55A and 55B. In detail, the plurality of contact projections 56A and 56B are disposed at almost equal intervals in the circumferential direction of each of the cap side through holes 55A and 55B. Each of the contact projections 56A and 56A slightly rises from the inner circumferential face of each of the cap side through holes 55A and 55B toward the inside in the radial direction.

As shown in FIG. 9, on both left and right side faces (an inner circumferential face) of the cap 13 forming the attachment recess 50, a pair of lock inner protrusions (a locked part) are protruded, and at the rear side of the pair of lock inner protrusions 52, a pair of lock recesses 53 (a locked part) are relatively recessed. A front end face of the lock inner protrusion 52 is inclined rearward from the inner circumferential face of the cap 13 toward the inside in a radial direction of the cap 13. Additionally, at the rear side of the pair of lock recesses 53 of the cap 13, a pair of lock confirmation windows 54 are opened. Each lock confirmation window 54 is an approximately rectangular hole penetrating the cap 13 in a thickness direction (the radial direction).

Furthermore, as shown in FIG. 8 and FIG. 9, on the base end wall 13A of the cap 13, the two bosses 57 and a posture setting boss 58 are protruded. The two bosses 57 and the posture setting boss 58 are protruded (extended) forward from the base end wall 13A (an opposite face facing to the water-proof seal 12). Each boss 57 is formed into an approximately circular rod-like shape having a length longer than a size of the water-proof seal 12 in the front and rear directions. The posture setting boss 58 is formed into an approximately circular rod-like shape having a length shorter than a size of the water-proof seal 12 in the front and rear direction and equal to or shorter than a half of a length of the boss 57. The two bosses 57 are disposed at both left and right sides of the base end wall 13A and between the cap side through holes 55A and 55B disposed adjacently in the upper and lower directions. The posture setting boss 58 is disposed near the center of the base end wall 13A. The two bosses 57 and the posture setting boss 58 are disposed at positions corresponding to the two boss through holes 43 and the posture setting hole 45 of the water-prof seal 12, respectively.

Each boss 57 has a boss main body 57A protruding on the cap 13 (the base end wall 13A) and a fitting tip end part 57B connected to a tip end portion (a front end portion) of the boss main body 57A. Each boss main body 57A is formed to have a diameter and a length so as to be capable of passing through the boss through hole 43 of the water-proof seal 12. Each fitting tip end part 57B has a cross section smaller than the boss main body 57A (has a diameter smaller than the boss main body 57A), and is connected to the tip end portion of the boss main body 57A via a contact face 57C (a step face). The contact face 57C is a part of a tip end face of the boss main body 57A formed in an annular shape, when viewed from the front side.

(Assembly of Connector)

Figure 10:
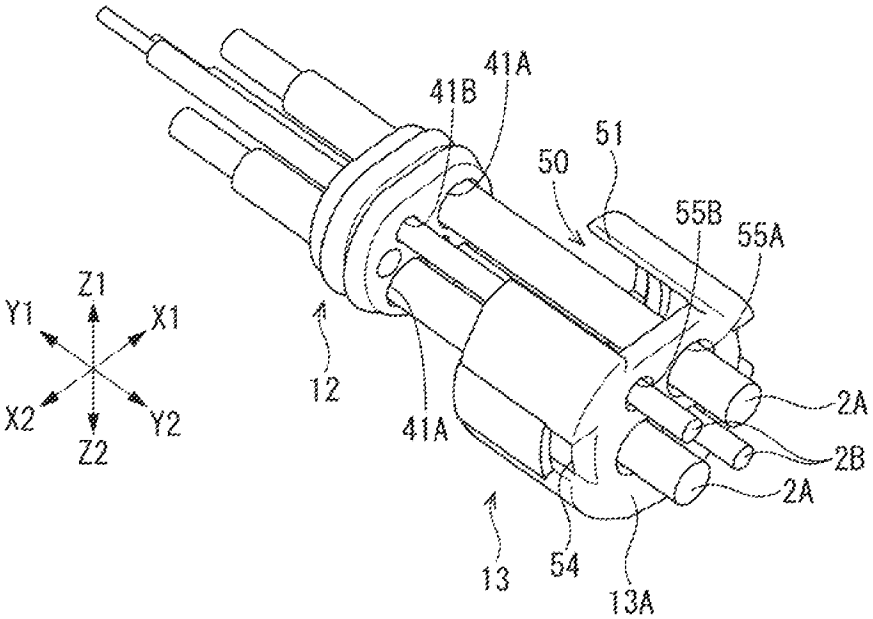
FIG. 10 is a perspective view showing a first process of a connector assembly method according to the embodiment of the present invention.
Figure 11:
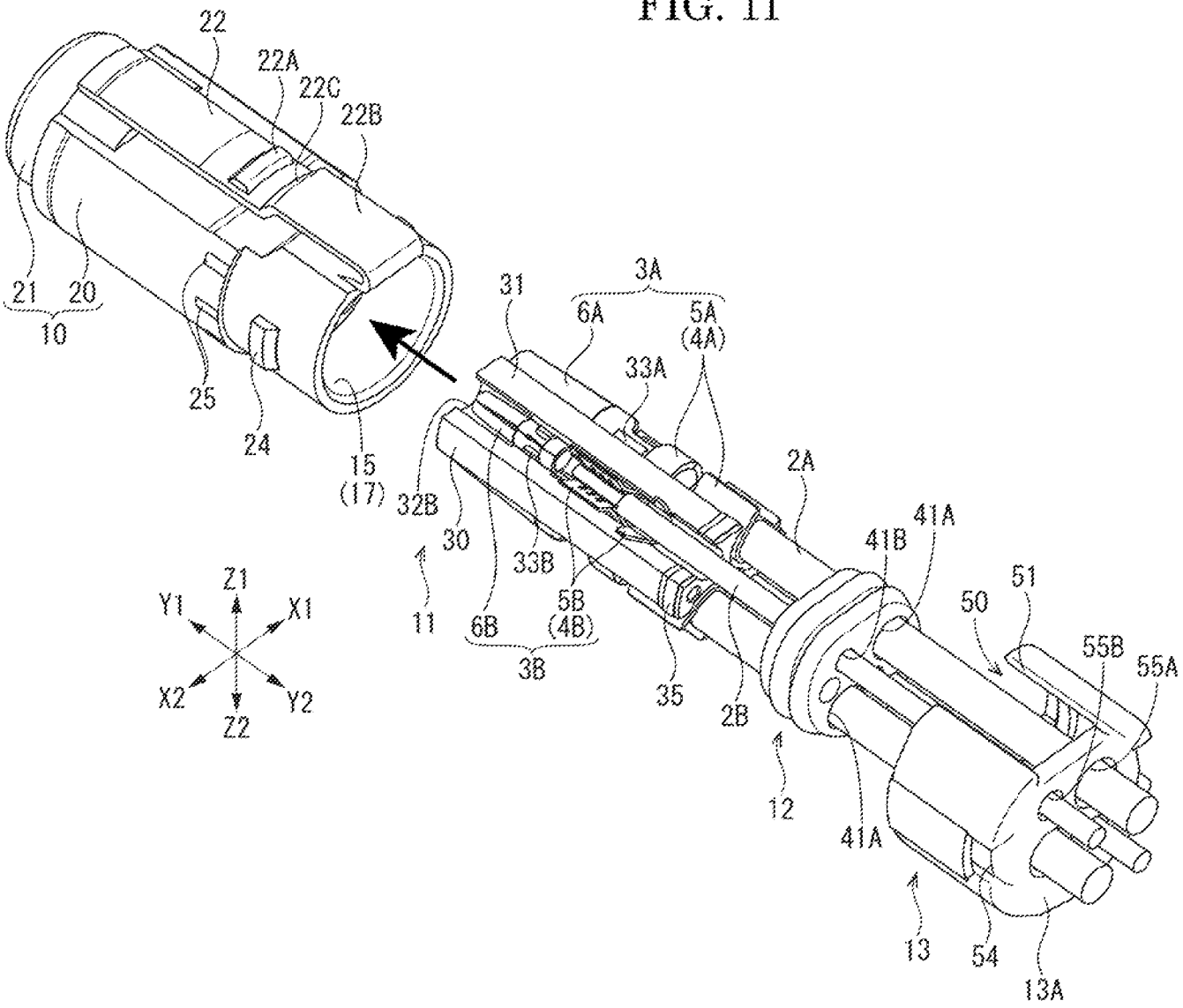
FIG. 11 is a perspective view showing a second process of the connector assembly method according to the embodiment of the present invention.
Figure 12:
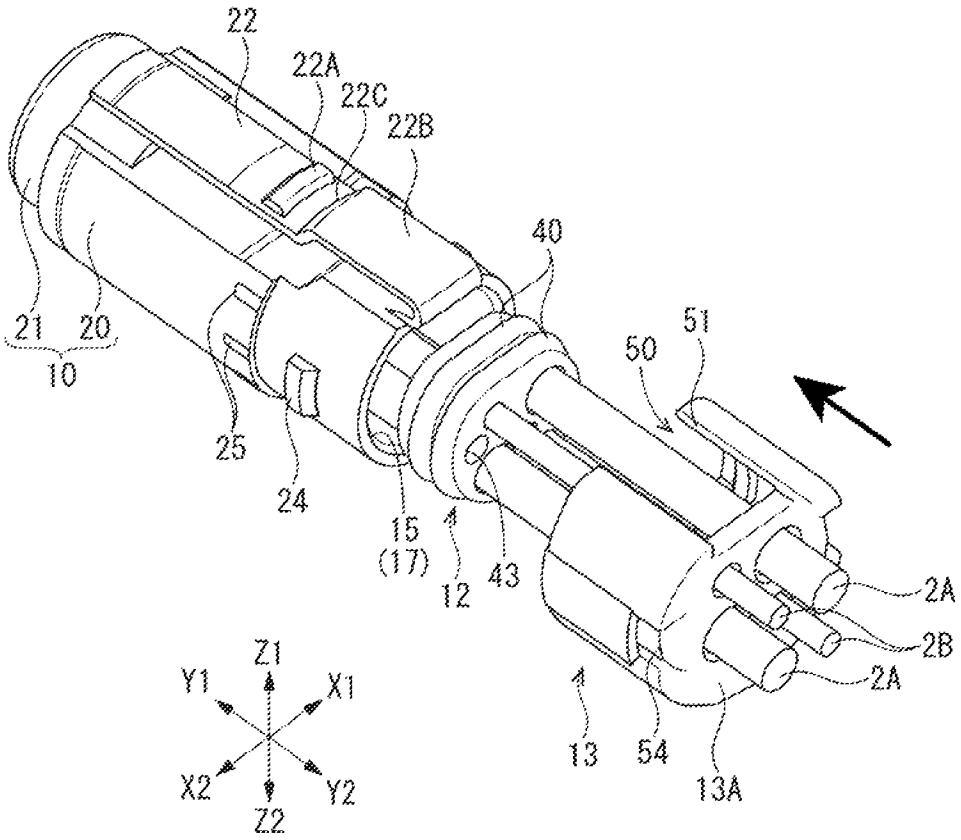
FIG. 12 is a perspective view showing a third process of the connector assembly method according to the embodiment of the present invention.
Figure 13:
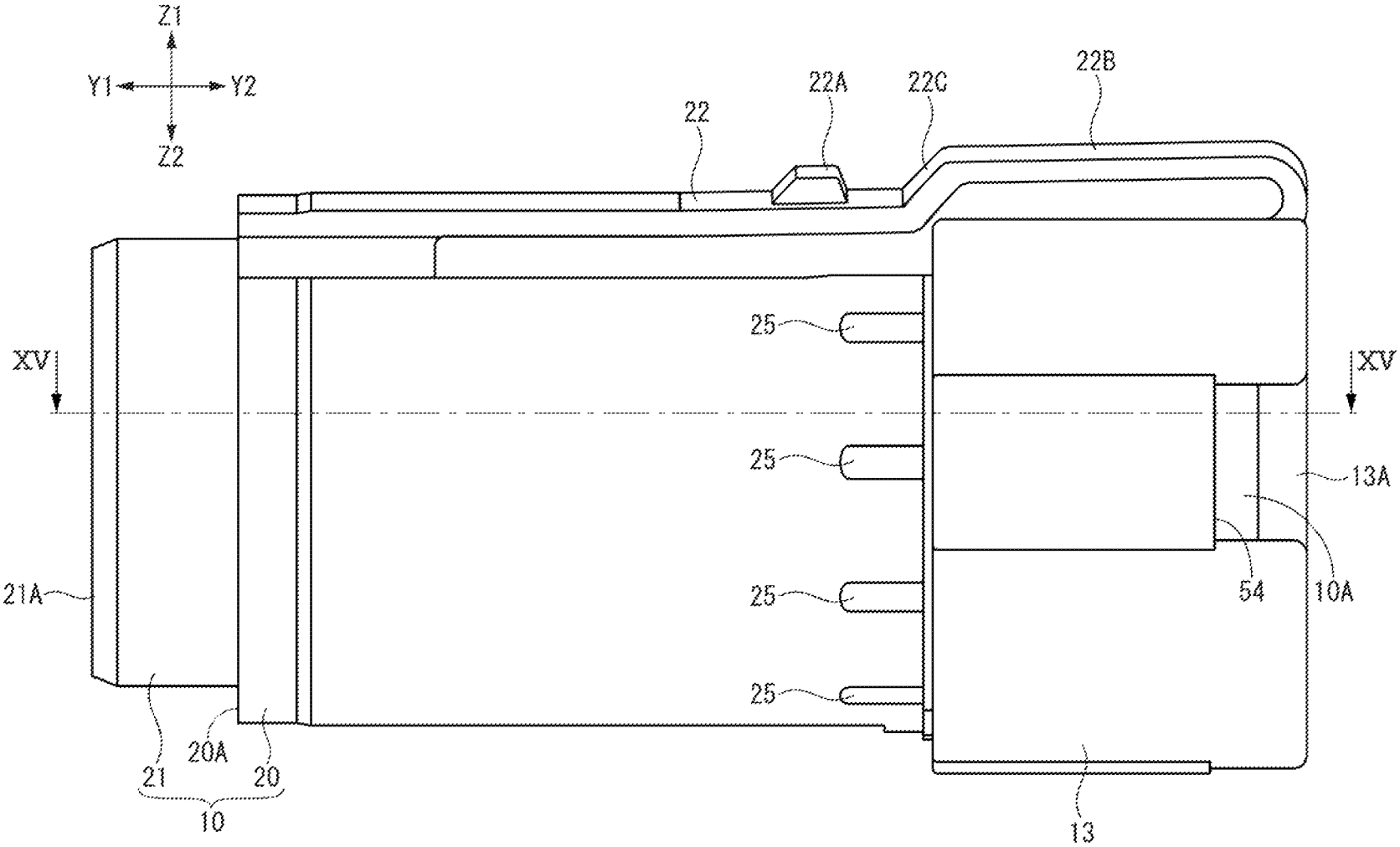
FIG. 13 is a side view showing the connector according to the embodiment of the present invention.
Figure 14:
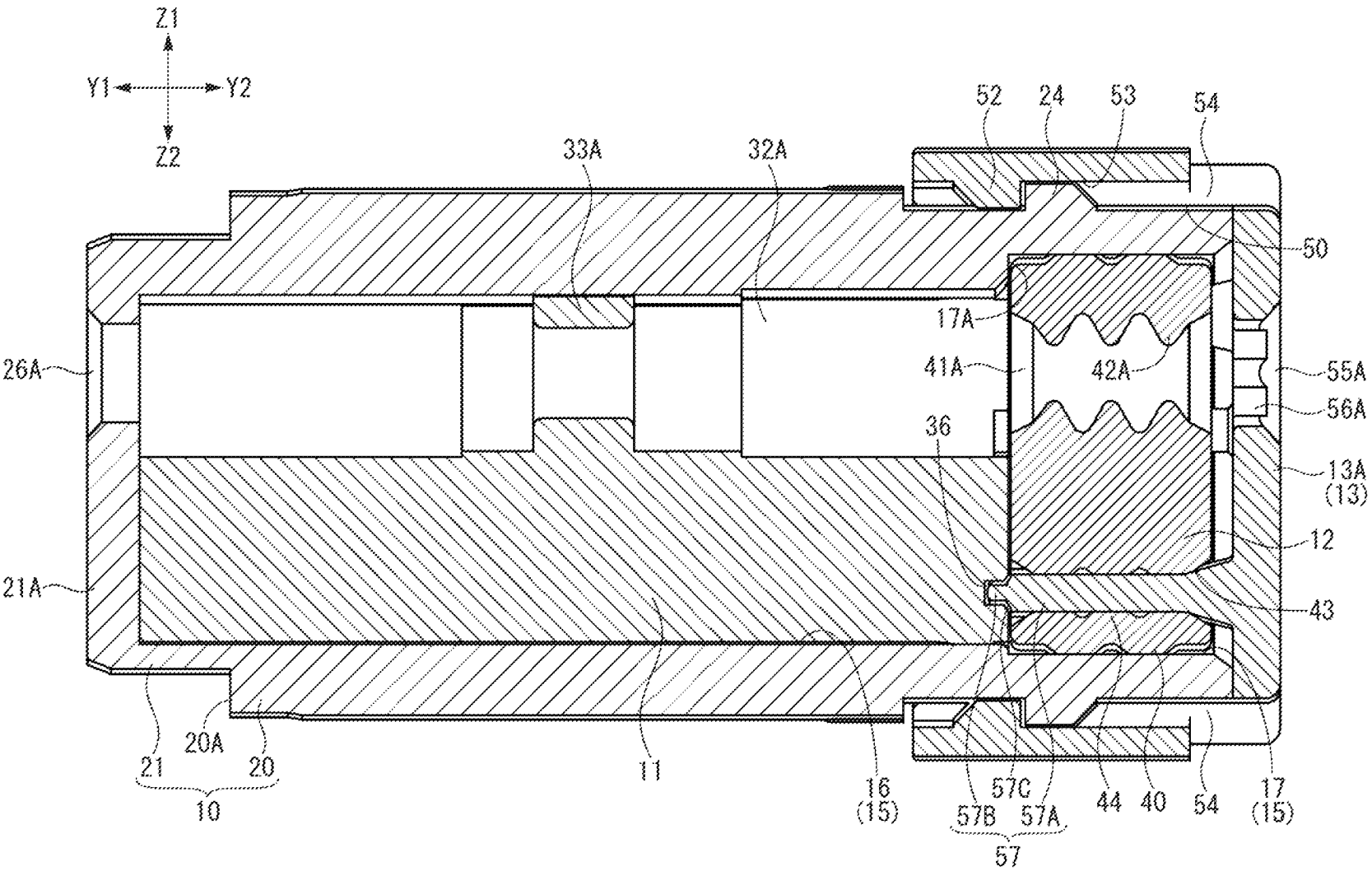
FIG. 14 is a sectional view showing a cross section of the connector taken along XIV-XIV line in FIG. 13.

Next, with reference to FIG. 2, FIG. 10 to FIG. 14, an assembly method for the connector 1 will be described. FIG. 10 is a perspective view showing the connector 1 during a first process of the assembly method for the connector 1. FIG. 11 is a perspective view showing the connector 1 during a second process of the assembly method for the connector 1. FIG. 12 is a perspective view showing the connector 1 during a third process of the assembly method for the connector 1. FIG. 13 is a side view showing the connector 1. FIG. 14 is a sectional view showing the cross section of the connector 1 taken along the XIV-XIV line in FIG. 13. FIG. 13 and FIG. 14 do not show the cables 2A and 2B and the terminals 3A and 3B.

<First Process>

In the first process, as shown in FIG. 10, an operator disposes the water-proof seal 12 to the attachment recess 50 (an opening of the attachment recess 50) of the cap 13 such that the posture setting hole 45 (refer to FIG. 6) faces to the attachment recess 50. Then, he passes each cable 2A through each seal side through hole 41A formed in the water-proof seal 12 and each cap side through hole 55A formed in the cap 13. In the same manner, he passes each cable 2B through each seal side through hole 41B and each cap side through hole 55B. In such a state, each of the inner protruded parts 42A and 42B (refer to FIG. 14) elastically comes into tightly contact with an outer circumferential face of each of the cables 2A and 2B disposed in the seal side through holes 41A and 41B. Thereby, water-proof performance between each of the cables 2A and 2B and the water-proof seal 12 is ensured. Additionally, tip end portions of the contact projections 56A and 56B come into contact with the outer circumferential face of each of the cables 2A and 2B disposed in the cap side through holes 55A and 55B so as to slightly bite the outer circumferential face of each of the cables 2A and 2B. The inner circumferential face of each of the cap side through holes 55A and 55B except the contact projections 56A and 56B slightly comes into contact or does not come into contact with the outer circumferential face of each of the cables 2A and 2B.

<Second Process>

Next, in the second process, the operator performs terminal treatment (exposing the core wire, and others) on a front end portion (the tip end portion in the axial direction) of each of the cables 2A and 2B extending forward from the water-proof seal 12 (refer to FIG. 10), and then fixes the terminals 3A and 3B to the cables 2A and 2B, respectively (refer to FIG. 2). Specifically, the operator disposes the front end portions (the end portions) of the cables 2A and 2B to the connection parts 4A and 4B of the terminals 3A and 3B, and then caulks the outer coverings and the core wires of the cables 2A and 2B with the barrels 5A and 5B using a tool. As a result, the end portions of the cables 2A and 2B are coupled to the terminals 3A and 3B. FIG. 2 and FIG. 11 shows the barrels 5A and 5B which are not caulked. The terminal treatment of the cables 2A and 2B may be performed in the first process or a pre-process before the first process.

Next, in the second process, as shown in FIG. 11, the operator makes the terminal holding body 11 hold the four terminals 3A and 3B. Specifically, the operator fits the four terminals 3A and 3B into the four terminal fitting grooves 32A and 32B, recessed in the terminal holding body 11, from the outside in a radial direction of the terminal holding body 11. Furthermore, the operator pushes a portion near a boundary between each of the connection parts 4A and 4B and each of the contact parts 6A and 6B in each of the terminals 3A and 3B into each of the terminal clamping parts 33A and 33B. Thus, each of the terminals 3A and 3B is tightly held by each of the terminal clamping parts 33A and 33B, and then, each of the terminals 3A and 3B and each of the cables 2A and 2B are kept in a state that being fitted into each of the terminal fitting grooves 32A and 32B.

<Third Process>

Next, in the third process, as shown in FIG. 12, the operator inserts the terminal holding body 11 holding each of the terminals 3A and 3B into the inside of the housing 10. Specifically, the operator disposes the terminal holding body 11 at the rear side of the housing 10 (refer to FIG. 11), and then, inserts the terminal holding body 11 into the fitting recess 15 of the housing 10. On this occasion, the operator aligns the fitting key 18 (refer to FIG. 3) of the housing 10 with the fitting key groove 34 (refer to FIG. 5) of the terminal holding body 11, and then, slides the terminal holding body 11 forward along the fitting key groove 34.

When insertion of the terminal holding body 11 into the fitting recess 15 is further advanced, the plurality of inner press projections 19 (refer to FIG. 4) protruded on the inner circumferential face of the housing 10 (the tip end connection part 21) comes into contact with front outer faces of each of the vertical arm parts 31 and each of the horizontal arm parts 30 of the terminal holding body 11. At the same time, the plurality of outer press projections 35 (refer to FIG. 5) protruding on the outer circumferential faces of the terminal holding body 11 (each vertical arm part 31 and each lateral arm part 30) come into contact with a rear inner face of the housing 10 (the housing main body 20). Then, since sliding resistance between the housing 10 and the terminal holding body 11 is increased, the operator feels resistance force (increasing of heaviness) via the terminal holding body 11. When the operator further advances pushing of the terminal holding body 11 into the housing 10 after he felt the resistance force, a tip end face of the terminal holding body 11 comes into contact with the inner face of the tip end wall 21A of the housing 10. Thereby, the pushing of the terminal holding body 11 is restricted, and the insertion of the terminal holding body into in the fitting recess 15 is completed.

As the above-described manner, the terminal holding body 11 becomes a state being disposed (accommodated) in the inside of the housing 10. In detail, the terminal holding body 11 becomes a state being fitted into the holding body fitting part 16 of the housing 10. In such a state, the plurality of inner press projections 19 are pressed to a front outer face of the terminal holding body 11 (each vertical arm part 31 and each horizontal arm part 30), and the plurality of outer press projections 35 are pressed to the rear inner face of the housing 10. Then, the terminal holding body 11 becomes a state being restricted from displacing inside the holding fitting recess 16. Furthermore, in such a state, the contact parts 6A and 6B of the four terminals 3A and 3B are disposed to face to the four terminal holes 26A and 26B of the tip end wall 21A.

<Fourth Process>

Next, in the fourth process, the operator displaces the cap 13 from the rear side to the front side along the cables 2A and 2B (refer to a thick arrow in FIG. 12). On this occasion, since the plurality of contact projections 56A and 56B of the cap 13 come into approximately point contact with the outer circumferential faces of the cables 2A and 2B to decrease sliding resistance between the cap 13 and each of the cables 2A and 2B, it is possible to slid the cap 13 along the cables 2A and 2B smoothly.

As shown in FIG. 13 and FIG. 14, the operator passes the two bosses 57 extending from the base end wall 13A of the cap 13 into the two boss through holes 43 formed in the water-proof seal 12 while fitting the water-proof seal 12 into the attachment recess 50 of the cap 13. At the same time, the operator inserts the posture setting boss 58 (refer to FIG. 9) extending from the base end wall 13A of the cap 13 into the posture setting hole 45 (refer to FIG. 6) formed in the water-proof seal 12. In such a state, the boss main body 57A of each boss 57 is disposed inside each boss through hole 43, and the fitting tip end part 57B of each boss 57 penetrates forward the water-proof seal 12 (the boss through hole 43). Furthermore, each boss protruded part 44 elastically comes into tightly contact with an outer circumferential face of each boss 57 disposed inside each boss through hole 43. Thereby, water-proof performance between each boss 57 and the water-proof seal is ensured. Process of passing each boss 57 and the posture setting boss 58 of the cap 13 through each boss through hole 43 and the posture setting hole 45 of the water-proof seal 12 may be performed at any process in the first to third processes.

Next, the operator displaces the cap 13 from the rear side to the front side together with the water-proof seal 12. In the cutout 51 of the cap 13, the lock operation part 22 (the lock rear portion 22B) of the housing 10 relatively enters (refer to FIG. 1). In the middle of process in which the cap 13 is fitted onto the outside of a rear portion of the housing 10, each lock inner protrusions 52 of the cap 13 comes into contact with each lock protrusion 24 of the housing 10.

When the cap 13 is further pushed forward, because the lock inner protrusions (inclined faces of the lock inner protrusions 52) are displaced along inclined faces of the lock protrusions 24, the cap 13 is pushed in while being deformed outward in the left and right directions. Then, when each lock inner protrusion 52 gets over each lock protrusion 24, each lock protrusion 24 is fitted into each lock recess 53 and comes into contact with (is locked with) a rear end face of each lock inner protrusion 52. Thereby, the cap 13 is fitted onto the outside of the rear portion of the housing 10 (covers the rear end portion of the housing 10) in a state being restricted from being extracted from the housing 10 (refer to FIG. 14).

As described above, the cap 13 is fixed to the housing 10 so as to face to a rear end face (the base end portion in the axial direction) of the water-proof seal 12 (refer to FIG. 14). Furthermore, in the state that each lock protrusion 24 is locked with each lock inner protrusion 52, the rear end portion 10A (the base end side in the axial direction) of the housing 10 is exposed through the pair of lock confirmation windows 54 (refer to FIG. 13).

Furthermore, in the above-described state, as shown in FIG. 14, the water-proof seal 12 is disposed inside the housing 10 so as to face to a rear end face (the base end portion in the axial direction) of the terminal holding body 11, and comes into tightly contact with the inner circumferential face of the housing 10. In detail, the water-proof seal 12 is fitted into the seal fitting part 17 of the housing 10, and the outside in the radial direction in the front end face of the water-proof seal 12 comes into contact with the seal contact face 17A. Furthermore, each outer protruded part 40 of the water-proof seal 12 comes into tightly contact with the inner circumferential face of the seal fitting part 17 in a state being deformed inward in the radial direction. Thereby, water-proof performance between the housing 10 and the water-proof seal 12 is ensured. The front end face of the water-proof seal 12 may come into contact with the rear end face of the terminal holding body 11 or may face to the rear end face via a small gap. The rear end face of the water-proof seal 12 may come into contact with the front end face of the cap 13 (the base end wall 13A) or may face to the front end face via a small gap.

Furthermore, in the above-described state, each boss 57 (the tip end portion of each boss 57) penetrating the water-proof seal 12 (the boss through hole 43) comes into contact with the rear end face of the terminal holding body 11. In detail, the contact face 57C of the boss main body 57A comes into contact with an outer edge portion of the boss fitting recess 36 of the terminal holding body 11, and the fitting tip end part 57B is fitted into the boss fitting recess 36.

In the above-described manner, the assembly for the connector 1 is completed. That is, the connector 1 is completed.

(Connection Operation of Connector)

Next, with reference to FIG. 1, operation when connecting the connector 1 to the counter connector 100 will be described.

The operator disposes the connector 1 at the rear side of the counter connector 100, and inserts the connector 1 (the housing 10) into the counter side fitting recess 103 of the counter connector 101. On this occasion, the operator aligns the connection key 104 of the counter housing 101 with the connection key groove 23 of the housing (refer to FIG. 4), and then, slides the connector 1 forward along the connection key groove 23.

When insertion of the connector 1 into the counter side fitting recess 103 is advanced, since the lock protrusion 22A of the lock operation part 22 of the housing 10 comes into contact with a rear end portion of the counter housing 101 and contact acts on inclination of the lock protrusion 22A downward, and the lock operation part 22 is inserted while elastically deformed downward. Then, the lock protrusion 22A is fitted into the lock hole 105 of the counter housing 101. Thereby, the connector 1 is fitted into the counter connector 100 in a state being restricted from being extracted from the counter connector 100. The rear end portion of the counter housing 101 is positioned at the front side of the lock inclined portion 22C (or comes into contact with the lock inclined portion 22C).

In such a state, an outer circumferential face of the tip end connection part 21 and the connection contact face 20A in the housing 10 come into tightly contact with a counter water-proof seal of the counter housing 101. Thereby, water-proof performance between the connector 1 and the counter connector 100 is ensured. Furthermore, in the state, the four counter terminals 102A and 102B of the counter connector 100 are inserted into the contact parts 6A and 6B of the four terminals 4A and 4B through the four terminal holes 26A and 26B opened in the tip end wall 21A of the housing 10. Since each of the contact parts 6A and 6B elastically clamps each of the counter terminals 102A and 102B, electrical connection between each of the terminals 3A and 3B and each of the counter terminals 102A and 102B is ensured. Furthermore, in the state, the plurality of connection press projections 25 of the housing (the housing main body 20) are pressed on the inner circumferential face of the counter housing 101. Thereby, the connecter 1 (the housing 10) is fitted into the counter housing 101 without looseness.

As described above, the connection of the connector 1 to the counter connector 100 is completed. In order to release the connection of the connector 1 to the counter connector 100, the operator may push down the lock rear portion 22B of the lock operation part 22 to remove the lock protrusion 22A from the lock hole 105, and then, draw the housing 10 rearward.

The connector 1 of the present embodiment described above has a configuration such that each boss 57 extending from the cap 13 passes through the water-proof seal 12 and comes into contact with the terminal holding body 11. According to the configuration, it is possible to transmit force for extracting the cables 2A and 2B from the terminal holding body 11 to each boss 57 and then to the cap 13 via each boss 57, for example. Thereby, since force transmitted to the water-proof seal 12 is deceased (or lost), it is possible to restrain excessive deformation of the water-proof seal 12. As a result, it is possible to continuously keep water-proof condition by the water-proof seal 12 suitably. The force transmitted to the cap 13 via each boss 57 is transmitted to the housing 10 to which the cap 13 is fixed. Furthermore, the force transmitted to the housing 10 is transmitted to the counter housing 101 via the lock operation part 22 (the lock protrusion 22A) and the others. Thereby, it is possible to oppose force of extracting the cables 2A and 2B.

According to the connector 1 of the present embodiment, it is possible to fit each of the terminals 3A and 3B into each of the terminal fitting grooves 32A and 32B from the outside in the radial direction of the terminal holding body 11. Therefore, for example, compared with a case where each of the terminals 3A and 3B is inserted into a hole extending in the axial direction, it is possible to make the terminal holding body 11 hold each of the terminals 3A and 3B easily.

As a conventional configuration other than the present invention, a case where the terminal holding body 11 has four holes for inserting the four terminals 3A and 3B will be considered. In this case, because it is very difficult to insert the four terminals 3A and 3B into the holes at the same time, the operator conventionally inserts the four terminals 3A and 3B one by one into the hole. For example, in a state that one terminal 3A fixed to one cable 2A is inserted into one hole, when the other terminal 3B fixed to the other cable 2B is inserted into the other hole, it is necessary to bend the cable 2B while loosening in order to direct the other terminal 3B to the opening of the other hole. Then, it is required for all the cables 2A and 2B to have a longer length considering the loosening. Then, the terminal holding body 11 and the others becomes long in the axial direction in order to correspond to the cables 2A and 2B longer than necessary, and the connector 1 is inhibited from downsizing. By contrast, according to the connector of the present embodiment, it is possible to fit the four terminals 3A and 3B into the four terminal fitting grooves 32A and 32B from the outside in the radial direction of the terminal holding body 11 without loosening the cables 2A and 2B. Thereby, it is possible for the cables 2A and 2B to have a required minimum length and to downsize the connector 1.

The connector 1 of the present embodiment 1 has a configuration such that each boss 57 is formed into a stepped rod-like shape and the tip end portion (the fitting tip end part 57B) of each boss 57 is fitted into the boss fitting recess 36 of the terminal holding body 11. According to the configuration, by fitting each fitting tip end part 57B into the boss fitting recess 36, it is possible to position the cap 13 to the terminal holding body 11 easily.

In the connector 1 of the present embodiment, the posture setting hole 45 is opened only to the rear end face of the water-poof seal 12. According to the configuration, when the operator directs the posture setting hole 45 on a side of the posture setting boss 58, an orientation of the water-proof seal 12 can be uniquely determined. Thereby, it is possible to prevent mistaking of the orientation of the water-proof seal 12 at the assembly of the connector 1.

According to the connector 1 of the present embodiment, the tip end portions of the plurality of contact projections 56A and 56B of the cap 13 come into approximately point contact with the outer circumferential faces of the cables 2A and 2B. Therefore, compared with a case where the entire inner circumferential faces of the cap side through holes 55A and 55B come into contact with the outer circumferential faces of the cables 2A and 2B, it is possible to pass the cables 2A and 2B through the cap side through holes 55A and 55B easily. Furthermore, since the plurality of contact projections 56A and 56B come into point contact with the outer circumferential faces of the cables 2A and 2B, it is possible to restrain the binding (the twisting) of the cables 2A and 2B extending to the outside from the cap side through holes 55A and 55B. Accordingly, it is possible to restrain a gap between each of the cables 2A and 2B and each of the seal side through holes 41A and 41B from being formed owing the twisting of the cables 2A and 2B.

According to the connector 1 of the present embodiment, in a state that the terminal holding body 11 is disposed inside the housing 10, the plurality of inner press projections 19 are pressed on the outer face of the terminal holding body 11 and the plurality of outer press projections 35 are pressed on the inner circumferential face of the housing 10. Therefore, it is possible to restrain the looseness of the terminal holding body 11 inside the housing 10. Furthermore, since each inner press projection 19 is provided in a front portion of the housing 10 and each outer press projection 35 is provided in the terminal holding body 11, the inner and outer press projections 19 and 35 come into contact with corresponding counter faces just before the completion of the insertion of the terminal holding body 11 into the housing 10. Thereby, in process of inserting the terminal holding body 11 into the housing 10 (a period from the start of the insertion to just before the completion of the insertion), the inner and outer press projections 19 and 35 do not generate resistance, and then, it is possible to slid the terminal holding body 11 smoothly.

In the connector 1 of the present embodiment, by locking each lock protrusion 24 with each lock inner protrusion 52, the cap 13 is locked to the housing 10. Additionally, in such a lock state, the rear end portion 10A of the housing 10 is exposed via the lock confirmation windows 54. According to the configuration, when the operator confirms the rear end portion 10A of the housing 10 exposed via the lock confirmation windows 54, he can confirm that the cap 13 is suitably locked to the housing 10. Thereby, it is possible to previously avoid mistaking the lock state in a state that the cap 13 is not locked to the housing 10. In order for the operator to clearly confirm that the rear end portion 10A of the housing 10 is exposed via the lock confirmation windows 54, the housing 10 and the cap 13 preferably have different color.

In the assembly method for the connector 1 of the present embodiment describe above, the water-proof seal 12 is pushed by the cap 13 to be displaced to the inside of the housing 10. Thereby, it is possible to push the water-proof seal 12 by the cap 13 with a constant and stable posture. Therefore, the water-proof seal 12 is disposed inside the housing with a stable posture and comes into tightly contact with the inner circumferential face of the housing 10, and accordingly, it is possible to achieve suitable water-proof performance.

According to the assembly method for the connector 1 of the present embodiment, it is possible to fit each of the terminals 3A and 3B into each of the terminal fitting grooves 32A and 32B from the outside in the radial direction of the terminal holding body 11. Thereby, compared with a case where each of the terminals 3A and 3B is inserted into the hole extending in the axial direction, it is possible to make the terminal holding body 11 hold each of the terminals 3A and 3B easily.

Although the connector 1 of the present embodiment has a configuration that the pair of boss fitting recesses 36 are recessed in the terminal holding body 11 and the pair of bosses 57 are protruded on the cap 13, the present invention is not limited by such a configuration. In the other configuration, the pair of boss fitting recesses 36 may be recessed in the cap 13 and the pair of bosses 57 may be protruded on the terminal holding body 11 (this example is not shown). That is, the boss 57 may be protruded on either one of the terminal holding body 11 and the cap 13 while the boss fitting recess 36 may be recessed in the other of the terminals holding body 11 and the cap 13. In the same manner, the posture setting hole 45 may be recessed on the front end face of the water-proof seal 12 while the posture setting boss 58 may be protruded on the terminal holding body 11 (this example is not shown). That is, the positioning setting hole 45 may be opened in only either one of the front end face and the rear end face of the water-proof seal 12 while the posture setting boss 58 may be protruded on either one of the terminal holding body 11 and the cap 13 depending on the posture setting hole 45.

Additionally, although the connector 1 of the present embodiment has a configuration that the cap 13 is provided with the two bosses 57 and the posture setting boss 58 while the water-proof seal 12 is provided with the two boss through holes 43 and the posture setting hole 45, the present invention is not limited by such a configuration. In the other configuration, at least one set of the boss 57 and the boss through hole 43 may be provided. Two or more sets of the posture setting boss 58 and the posture setting holes 45 may be provided, or the posture setting boss 58 and the posture setting holes 45 may not be provided.

Additionally, although the connector 1 of the present embodiment has a configuration that the tip end portion (the fitting tip end part 57B) of the boss 57 of the cap 13 is fitted into the boss fitting recess 36 of the terminal holding body 11, the present invention is not limited by such a configuration. In the other configuration, for example, the fitting tip end part 57B may not be provided and the tip end portion of the boss main body 57A of the boss 57 may be fitted into the boss fitting recess 36. Alternatively, for example, the boss fitting recess 36 and the fitting tip end part 57B may not be provided and the tip end face of the boss main body 57A may come into contact with the rear end face of the terminal holding body 11.

Additionally, although the connector 1 of the present embodiment has a configuration that the terminals 3A and 3B are fitted into the terminal holding body 11 (the terminal fitting grooves 32A and 32B) from the outside in the radial direction of the terminal holding body 11, the present invention is not limited by such a configuration. In the other configuration, for example, the terminals 3A and 3B may be inserted into the terminal holding body 11 in the axial direction (this example is not shown).

Additionally, although the connector 1 of the present embodiment has a configuration that the terminals 3A and 3B have different thickness and the cables 2A and 2B have different thickness, the present invention is not limited by such a configuration. In the other configuration, for example, all the four terminals 3A and 3B may have the same thickness or different thickness, and all the four cables 2A and 2B may have the same thickness or different thickness (this example is not shown). The numbers of the terminals 3A and 3B and the cables 2A and 2B may be at least one, and may be increased and decreased suitably. In these cases, the housing 10, the terminal holding body 11, the water-proof seal 12 and the cap 13 may be suitably changed depending on the cross sections and the numbers of the terminals 3A and 3B and the cables 2A and 2B (the example is not shown).

Additionally, although the connector 1 of the present embodiment has a configuration that the housing 10 is provided with the plurality of inner press projections 19 and the terminal holding body 11 is provided with the plurality of outer press projections 35, the present invention is not limited by such a configuration. In the other configuration, at least one of the inner press projections 19 and at least one of the outer press projections 35 may be provided. Additionally, although the connector 1 of the present embodiment has a configuration that each inner press projection 19 is provided on the front portion of the housing 10 and each outer press projection 35 is provided in the terminal holding body 11, the present invention is not limited by such a configuration. In the other configuration, for example, each inner press projection 19 and each outer press projection 35 may be provided in the middle portions in the front and rear directions (the axial direction) (the example is not shown).

It should be noted that the description of the above embodiments shows one aspect of the connector and the assembly method of the connector according to the present invention, and the technical scope of the present invention is not limited to the above embodiment. The components in the above embodiments may be replaced or combined with existing components or the like as appropriate, and the description of the above embodiments does not limit the contents of the invention describes in the claims.

The invention claimed is:

1. A connector comprising:

a housing formed into a cylindrical shape;

a terminal holding body holding a terminal fixed to a tip end portion of a cable in an axial direction, and disposed inside the housing;

a water-proof seal disposed inside the housing so as to face to a base end portion of the terminal holding body in the axial direction, and coming into tight contact with an inner circumferential face of the housing; and a cap fixed to the housing so as to face to a base end portion of the water-proof seal in the axial direction, and pressing the water-proof seal, wherein the water-proof seal has a seal side through hole receiving passing-through of the cable, and a boss through hole formed in parallel to the seal side through hole, the cap has a cap side through hole receiving passing-through of the cable at a position corresponding to the seal side through hole, one of the terminal holding body and the cap has a boss which is protruded from an opposite face facing to the water-proof seal toward the other of the terminal holding body and the cap, passes through the boss through hole and comes into contact with the other of the terminal holding body and the cap, on an inner circumferential face of the cap side through hole, a plurality of contact projections are projected toward a center in a radial direction of the cap side through hole at positions separated at intervals in a circumferential direction of the cap side through hole, and tip end portions of the plurality of contact projections come into contact with an outer circumferential face of the cable disposed in the cap side through hole.

2. The connector according to claim 1, wherein the terminal holding body has a terminal fitting groove into which the terminal is fitted, and the terminal fitting groove is recessed from an outside to an inside in a radial direction of the terminal holding body perpendicular to the axial direction of the cable.

3. The connector according to claim 2, wherein the terminal is one of a plurality of the terminals corresponding to a plurality of the cables, and the terminal holding body has a plurality of the terminal fitting grooves corresponding to the plurality of the terminals.

4. The connector according to claim 1, wherein the other of the terminal holding body and the cap has a boss fitting recess, the boss has a boss main body protruded from one of the terminal holding body and the cap, and a fitting tip end part having a cross section smaller than a cross section of the boss main body, and connected to a tip end portion of the boss main body via a contact face, the contact face of the boss main body comes into contact with an outer edge portion of the boss fitting recess, and the fitting tip end part is fitted into the boss fitting recess.

5. The connector according to claim 1, wherein the water-proof seal has a posture setting hole opened in only one of a tip end portion and the base end portion of the water-proof seal in the axial direction, one of the terminal holding body and the cap has a posture setting boss which is protruded from the opposite face facing to the water-proof seal toward the other of the terminal holding body and the cap and is inserted into the posture setting hole.

6. The connector according to claim 1, wherein an inner press projection is projected from an inner circumferential face of the housing, the inner press projection is pressed on an outer face of the terminal holding body in a state that the terminal holding body is disposed inside the housing, an outer press projection is projected from the outer face of the terminal holding body, and the outer press projection is pressed on the inner circumferential face of the housing in the state that the terminal holding body is disposed inside the housing.

7. The connector according to claim 1, wherein a plurality of lock parts are formed on an outer circumferential face of the housing at a base end side in the axial direction, the cap has a plurality of locked parts to which the plurality of lock parts are locked in a state that the cap covers a base end portion of the housing in the axial direction, the cap has a lock confirmation window which is opened at the base end side from the locked parts in the axial direction, and the base end side of the housing in the axial direction is exposed via the lock confirmation window in a state that the lock parts are locked to the locked parts.

8. An assembly method for a connector including a housing accommodating a terminal holding body holding a terminal fixed to a tip end portion of a cable in an axial direction, a water-proof seal coming into tightly contact with an inner circumferential face of the housing, and a cap pressing the water-proof seal, the assemble method comprising:

a first process for passing the cable through a seal side through hole formed in the water-proof seal and a cap side through hole formed in the cap;

a second process for fixing the terminal to the tip end portion in the axial direction of the cable extending from the water-proof seal, and making the terminal holding body hold the terminal;

a third process for inserting the terminal holding body holding the terminal inside the housing; and a fourth process containing the following steps:

a step for displacing the cap from a base end toward a tip end in the axial direction together with the water-proof seal to dispose the water-proof seal inside the housing so as to face to a base end portion of the terminal holding body in the axial direction;

a step for bringing a boss, protruding from one of the terminal holding body and the cap toward the other of the terminal holding body and the cap and passing through a boss through hole formed in the water-proof seal, into contact with the other of the terminal holding body and the cap; and a step for fixing the cap to the housing such that the cap faces to a base end portion of the water-proof seal in the axial direction, wherein the first process makes an outer circumferential face of the cable, that is disposed in the cap side through hole, come into contact with tip end portions of a plurality of contact projections that are projected toward a center in a radial direction of the cap side through hole at positions separated at intervals in a circumferential direction of the cap side through hole on an inner circumferential face of the cap side through hole.

9. The assembly method for a connector, according to claim 8, wherein in the second process, the terminal is held to the terminal holding body by fitting the terminal into a terminal fitting groove recessed from an outside to an inside in a radial direction of the terminal holding body perpendicular to the axial direction.

10. A connector comprising:

a housing formed into a cylindrical shape;

a terminal holding body holding a terminal fixed to a tip end portion of a cable in an axial direction, and disposed inside the housing;

a water-proof seal disposed inside the housing so as to face to a base end portion of the terminal holding body in the axial direction, and coming into tight contact with an inner circumferential face of the housing; and a cap fixed to the housing so as to face to a base end portion of the water-proof seal in the axial direction, and pressing the water-proof seal, wherein the water-proof seal has a seal side through hole receiving passing-through of the cable, and a boss through hole formed in parallel to the seal side through hole, the cap has a cap side through hole receiving passing-through of the cable at a position corresponding to the seal side through hole, one of the terminal holding body and the cap has a boss which is protruded from an opposite face facing to the water-proof seal toward the other of the terminal holding body and the cap, passes through the boss through hole and comes into contact with the other of the terminal holding body and the cap, the water-proof seal has a posture setting hole opened in only one of a tip end portion and the base end portion of the water-proof seal in the axial direction, and one of the terminal holding body and the cap has a posture setting boss which is protruded from the opposite face facing to the water-proof seal toward the other of the terminal holding body and the cap and is inserted into the posture setting hole.

* * * * *